US007714722B2

(12) United States Patent
Marszalek et al.

(10) Patent No.: US 7,714,722 B2
(45) **Date of Patent: *May 11, 2010**

(54) APPARATUS, A SYSTEM AND A METHOD FOR SECURING AND/OR FOR DISPLAYING A DEVICE ON A FIXTURE

(75) Inventors: Christopher Marszalek, Plainfield, IL (US); Daniel Horvath, Plainfield, IL (US); Sorin Petrusan, Chicago, IL (US); James D. Kovacik, Brecksville, OH (US)

(73) Assignee: Sennco Solutions, Inc, Plainfield, IL (US)

( * ) Notice: Subject to any disclaimer, the term of this patent is extended or adjusted under 35 U.S.C. 154(b) by 1077 days.

This patent is subject to a terminal disclaimer.

(21) Appl. No.: 11/318,790

(22) Filed: Dec. 27, 2005

(65) Prior Publication Data

US 2007/0152819 A1 Jul. 5, 2007

(51) Int. Cl.
*G08B 13/12* (2006.01)

(52) U.S. Cl. ..... 340/568.2; 340/568.3; 340/568.4; 340/506

(58) Field of Classification Search ..... 340/568.2, 340/568.1, 568.4, 568.8, 571, 568.3
See application file for complete search history.

(56) References Cited

U.S. PATENT DOCUMENTS

| | | | |
|---|---|---|---|
| 4,896,140 | A | 1/1990 | Biever et al. |
| 5,066,942 | A | 11/1991 | Matsuo |
| 5,072,213 | A | 12/1991 | Close |
| 5,124,685 | A | 6/1992 | Rankin |
| 5,172,098 | A | 12/1992 | Leyden et al. |
| 5,552,771 | A | 9/1996 | Leyden et al. |
| 5,565,848 | A | 10/1996 | Leyden et al. |
| 5,676,258 | A | 10/1997 | Leyden et al. |
| 6,019,304 | A | 2/2000 | Skowronski et al. |
| 6,027,277 | A | 2/2000 | Leyden et al. |
| 6,039,498 | A | 3/2000 | Leyden et al. |
| 6,087,939 | A | 7/2000 | Leyden et al. |
| RE37,590 | E | 3/2002 | Leyden et al. |
| 6,386,906 | B1 | 5/2002 | Burke |
| 6,495,756 | B1 | 12/2002 | Burke et al. |
| 6,756,900 | B2 * | 6/2004 | Leyden et al. ..... 340/568.4 |

(Continued)

FOREIGN PATENT DOCUMENTS

| | | | |
|---|---|---|---|
| GB | 2 128 790 | A | 5/1984 |

*Primary Examiner*—Toan N Pham
(74) *Attorney, Agent, or Firm*—Patents + TMS, P.C.

(57) ABSTRACT

An apparatus, a system and a method secure and/or display a device on a fixture. Additionally, the apparatus, the system and the method attach and/or secure the device and/or a detachable means of the device to the fixture. A housing and/or a cable connects the device and/or the detachable means of the device to an alarm box and/or an alarm board. The housing has an optical sensor and/or a sensor board with a micro-controller and/or a resistor in communication with the micro-controller. The alarm box and/or the alarm board is in communication with an optical sensor and/or the micro-controller via a cable. A power source is in communication with the micro-controller via the cable to control a voltage which delivers from the power source to the device. Furthermore, the cable extends outward with respect to the fixture and/or a retracting means which allows the device and/or the detachable element of the device to be manipulated and/or to be examined by a customer and/or a user.

7 Claims, 6 Drawing Sheets

U.S. PATENT DOCUMENTS 6,761,579 B2 7/2004 Fort et al.
6,799,994 B2 10/2004 Burke
7,202,786 B2 * 4/2007 Marszalek et al. ..... 340/568.3
7,327,276 B1 * 2/2008 Deconinck et al. ..... 340/687

* cited by examiner

APPARATUS, A SYSTEM AND A METHOD FOR SECURING AND/OR FOR DISPLAYING A DEVICE ON A FIXTURE

BACKGROUND OF THE INVENTION

The present invention generally relates to an apparatus, a system and a method for securing and/or for displaying a device on a fixture. More specifically, the present invention relates to an apparatus, a system and a method for securing and/or for displaying a portable electronic device, such as, for example, a camera, a camcorder, a digital camera, a digital music player, a video game, a digital video player, a digital video recorder, a personal data assistant (hereinafter "a PDA"), a cellular telephone and/or the like. The apparatus, the system and the method for securing and/or for displaying the device on the fixture may be utilized to prevent theft of and/or destruction of the device. The device may be a portable electronic device which may be, for example, displayed for sale by a retailer, a wholesaler and/or the like.

The apparatus, the system and the method for securing and/or for displaying the device on the fixture may have a housing attached to the device. A sensor board and/or an optical sensor may be contained within the housing. The sensor board may have a first micro-controller and/or the first micro-controller may be in communication with an optical sensor. The sensor board may be connected to an alarm box, an alarm board and/or a power source. Further, the alarm box and/or the alarm board may be in communication with the optical sensor on the sensor board and/or an external sensor via a cable. The optical sensor may monitor and/or may detect detachment of the device from the sensor board and/or the housing. Alternatively, the optical sensor may detect an attempt to separate the device from the sensor board and/or the housing. As a result, the alarm box may be activated and/or an audio signal may be produced. The external sensor may detect detachment of a detachable element of the device.

The sensor board may have a resistor thereon and/or the resistor may be in communication with the device and/or the second micro-controller on the sensor board. The power source may be in communication with and/or may be controlled by the second micro-controller on the sensor board via the cable. The second micro-controller and/or the resistor may control a voltage from the power source to the device. Moreover, the sensor board may have a first light emitting diode (hereinafter "LED") may indicate that the device is secured to the housing and/or may indicate that the detachable element of the device is secured to the housing. A second LED may indicate that the voltage is provided to the device.

It is generally known, for example, that vendors, retailers and/or wholesalers may display a device to a customer at, for example, a retail store and/or sales facility. The device is a camera, a digital camera, a portable compact disc player, a PDA and/or a cellular telephone. The device may have a detachable element, such as, for example, a camera lens, an ear piece, head phones, a head set, a wireless head set, a battery, a speaker, a case to hold the device therein and/or the like. The device is traditionally displayed in conjunction with a fixture, such as, for example, a cabinet, a table, a wall, a column, a shelf and/or the like. A cable attaches the device to the fixture. The device is secured to the fixture by the cable. Often, the cable is not durable to prevent breaking and/or allows the device to be easily separated from the fixture.

An alarm system is often provided that attaches to the device. An attaching means is utilized to secure the device to the alarm system and/or the fixture. However, the attaching means and/or the device may be manipulated by an individual attempting to steal and/or to damage the device. The device may be separated from the alarm system and/or the attaching means by the individual. As a result, the individual may steal and/or may damage the device. Moreover, the detachable element of the device is not secured by the alarm system and/or the attaching means. As a result, the individual may steal and/or may damage the detachable element.

Often, a second cable is required to attach the alarm system to the device. A third cable, such as, for example, a power cable is connected to the device to supply a voltage to the device. Each device requires a specific voltage, such as, for example, five volts to operate without damaging the device. Often, the power cable contains pairs of electrical wires which attach directly to the device. However, each pair of electrical wire is only capable of delivering a single voltage, such as, for example, five volts. Therefore, only one pair of electrical wires provide the specific voltage required by the device. As a result, different pairs of electrical wires must be provided and/or utilized with each device which requires a different voltage, such as, for example, seven volts. Having to attach a different pair of wires to each device is inconvenient and/or is burdensome.

Furthermore, the cables which secure the device often prevent a customer and/or a user from manipulating and/or examining the device. The device is often fixed to a surface of the fixture or the cable attaching the device to the fixture has a length which is not adjustable. Accordingly, the customer and/or the user may not be able to pick up and/or to move the device to examine the device, such as, to examine various characteristics of the device for example, the weight, the texture, the feel, the configuration of the device and/or the like. A longer cable incorporated with the device and/or the fixture allows the customer and/or the user to examine the device. However, the longer cable is impractical and/or tangles with other cables and/or the device or other devices. Furthermore, the customers and/or the user having disabilities are prevented from moving the device to a location which allows for examination and/or inspection of the device.

A need, therefore, exists for an apparatus, a system and a method for securing and/or for displaying the device on the fixture. Additionally, a need exists for an apparatus, a system and a method for securing and/or displaying the device on the fixture which may provide mechanical security and electrical security to the device and/or the detachable element of the device. Further, a need exists for an apparatus, a system and a method for securing and/or displaying the device on the fixture which may visibly indicate that the device and/or the detachable element of the device is mechanically secured and/or is electrically secured. Still further, a need exists for an apparatus, a system and a method for securing and/or displaying the device on the fixture which may utilize a retracting means to adjust a length of the cable. Moreover, a need exists for an apparatus, a system and a method for securing and/or displaying the device on the fixture which may trigger an alarm when the device and/or the detachable element of the device is separated from the alarm box and/or the housing. Furthermore, a need exists for an apparatus, a system and a method for securing and/or displaying the device on the fixture which may utilize a micro-controller and/or a resistor to provide a voltage from a power source to the device corresponding to a required operational voltage of the device.

SUMMARY OF THE INVENTION

The present invention relates to an apparatus, a system and a method for securing and/or for displaying a portable electronic device on a fixture. Further, the apparatus, the system and the method for securing and/or for displaying the device on a fixture may attach and/or may secure the device to the fixture via a housing and/or a cable. The apparatus, the system and the method for securing and/or for displaying may attach and/or may secure a detachable element of the device to the housing and/or the fixture.

The housing may have an optical sensor in communication with a sensor board which connects the device to an alarm box, an alarm board and/or a power source. A micro-controller and/or a resistor may control a voltage which may be delivered from the power source to the device. The housing, the sensor board, the optical sensor, the alarm box and/or the alarm board may secure the device and/or the detachable element of the device to the fixture. A retracting mean may allow the cable to be extendable outward with respect to the fixture and/or a base which may allow the device to be manipulated and/or to be examined by a customer and/or a user.

To this end, in an embodiment of the present invention, an apparatus for securing a device is provided. The apparatus has a connector having walls defining an interior wherein the connector attaches to the device to provide electrical power to the device. Further, the apparatus has a controller connected to the device wherein the controller is within the interior of the connector and further wherein the controller is in communication with the device. Still further, the apparatus has a sensor in communication with the controller wherein the sensor is within the interior of the connector. Moreover, the apparatus has an alarm in communication with the controller wherein the sensor communicates with the alarm via the controller and a pin sensed by the sensor wherein the sensor detects a position of the pin and activates the alarm in response to a change in the position of the pin.

In an embodiment, the apparatus has a light emitting diode in communication with the controller.

In an embodiment, the apparatus has a passage in the wall of the connector wherein the pin extends through the passage.

In an embodiment, the apparatus has a cable connecting the controller to the alarm.

In another embodiment of the present invention, a system for monitoring a device wherein the device is secured to a fixture is provided. The system has a base having an interior and a first controller attached to an alarm and a power source wherein the first controller communicates with the alarm and the power source. Further, the system has an attaching means connecting the device to the first controller wherein the attaching means extends from the first controller through the base to the device wherein the attaching means provides electrical power from the power source to the device. Moreover, the system has a sensor detecting a condition between the attaching means and the device wherein the sensor activates the alarm via the first controller.

In an embodiment, the base is attached to the fixture.

In an embodiment, the attaching means is a cable.

In an embodiment, the system has a pulley in the interior of the base.

In an embodiment, the system has a second controller connecting the device to the first controller.

In an embodiment, the system has a pin detected by the sensor.

In an embodiment, the system has a monitor in communication with the device.

In another embodiment of the present invention, a method for monitoring a secured condition of a device wherein the device requires a voltage. The method has the step of providing a first controller having an alarm and a power source wherein the power source provides the voltage to the device. Further, the method has the step of providing a second controller that communicates with the device wherein the second controller provides the voltage to the device from the power source and further wherein the first controller is remotely positioned from the second controller. Moreover, the method has the step of activating the alarm wherein the second controller senses a breach of the secured condition and signals the first controller.

In an embodiment, the method has the step of providing an external sensor to communicate with the second controller.

In an embodiment, the method has the step of providing a monitor in communication with the device.

In an embodiment, the method has the step of programming the second controller with a voltage necessary to power the device.

In an embodiment, the method has the step of communicating the voltage required to operate the device from the device to the first controller via the second controller.

In an embodiment, the method has the step of indicating that the second controller is in communication with the first controller.

In an embodiment, the method has the step of transmitting a signal from the device to the first controller.

In another embodiment of the present invention, an apparatus for extending a cable wherein the cable has a continuous length defined between a first end and a second end opposite to the first end is provided. The apparatus has a fixed end and a movable end wherein the fixed end is remotely positioned from the movable end wherein the first end of the cable is secured to the fixed end and further wherein the cable extends between the fixed end and the movable end. Moreover, the apparatus has a pulley between the fixed end and the movable end wherein the pulley receives the cable and further wherein the pulley guides the second end of the cable outward with respect to the movable end wherein the pulley moves between the fixed end and the movable end.

In an embodiment, the apparatus has a roller between the pulley and the fixed end.

In an embodiment, the second end of the cable extends from the movable end in a direction that is non-parallel to the cable.

In an embodiment, the apparatus has an arm attaching the pulley and the movable end.

In an embodiment, the apparatus has a passage in the fixed end.

In another embodiment of the present invention a method for extending a cable wherein the cable has a length defined between a first end and a second end is provided. The method has the step of providing a base having an interior defined between a first end and a second end. Moreover, the method has the steps of providing a pulley in the interior of the base and extending the cable from the interior of the base wherein the cable moves the pulley within the interior of the base between the first end and the second end of the base as the length of the cable extends exterior to the base.

In an embodiment, the method has the step of moving the pulley inward with respect to the second end of the base.

In an embodiment, the method has the step of pulling the second end of the cable inward with respect to the interior of the base.

In an embodiment, the method has the step of directing the cable through the interior of the base.

In an embodiment, the method has the step of attaching an arm between the pulley and the second end of the base.

It is, therefore, an advantage of the present invention to provide an apparatus, a system and a method for securing and/or for displaying a device on a fixture which may mechanically secure and/or may electrically secure the device and/or a detachable element of the device.

Another advantage of the present invention is to provide an apparatus, a system and a method for securing and/or for displaying a device on a fixture may attach the device and/or a detachable element of the device to a fixture.

And, another advantage of the present invention is to provide an apparatus, a system and a method for securing and/or for displaying a device on a fixture which may visibly display that the device and/or a detachable element of the device is mechanically attached to the fixture.

Yet another advantage of the present invention is to provide an apparatus, a system and a method for securing and/or for for displaying a device on a fixture which may visibly display that an electrical alarm has been activated and/or has been connected to the device and/or a detachable element of the device.

A further advantage of the present invention is to provide an apparatus, a system and a method for securing and/or for displaying a device on a fixture which utilize an optical sensor in a housing to secure the device and/or a detachable element of the device to the fixture.

Moreover, an advantage of the present invention is to provide an apparatus, a system and a method for securing and/or for displaying a device on a fixture which provides a voltage to the device corresponding to a required operational voltage of the device.

And, another advantage of the present invention is to provide an apparatus, a system and a method for securing and/or for displaying a device on a fixture which utilizes a micro-controller and/or a resistor to provide a voltage between one volt and twenty volts to the device.

Yet, another advantage of the present invention is to provide an apparatus, a system and a method for securing and/or for displaying a device on a fixture which utilizes a cable and a retracting means to attach the device to the fixture.

Another advantage of the present invention is to provide an apparatus, a system and a method for securing and/or for displaying a device on a fixture which provides a rechargeable battery back-up in a alarm box to secure the device and/or a detachable element of the device.

Yet another advantage of the present invention is to provide an apparatus, a system and a method for securing and/or for displaying a device on a fixture which allows the device to be removed from a base on the fixture and/or examined by a customer and/or a user.

A still further advantage of the present invention is to provide an apparatus, a system and a method for securing and/or for displaying a device on a fixture which provides an optical sensor and/or an audio signal to indicate a tampering with security of the device and/or a detachable element of the device.

Moreover, an advantage of the present invention is to provide an apparatus, a system and a method for securing and/or for displaying a device on a fixture which provides a micro-controller and/or resistor in communication with a power source.

And, another advantage of the present invention is to provide an apparatus, a system and a method for securing and/or for displaying a device on a fixture which utilizes a box-shaped retracting means that is smaller than a conventional reel.

Yet another advantage of the present invention is to provide an apparatus, a system and a method for securing and/or for displaying a device on a fixture which provides an LED indicating the device is mechanically secured and/or is electrically secured.

A further advantage of the present invention is to provide an apparatus, a system and a method for securing and/or for monitoring a device which provides a dual sensor to indicate that a voltage is provided to the device and/or that a detachable element of the device is secured.

Moreover, an advantage of the present invention is to provide an apparatus, a system and a method for securing and/or for displaying a device on a fixture which provides an optical sensor in communication with an alarm box.

A still further advantage of the present invention is to provide an apparatus, a system and a method for securing and/or for displaying a device on a fixture which utilizes a plunger switch and/or an adhesive to secure a detachable element of the device.

Yet another advantage of the present invention is to provide an apparatus, a system and a method for securing and/or for displaying device on a fixture which provides a retracting means to controlling a distance between the device and the fixture.

A still further advantage of the present invention is to provide an apparatus, a system and a method for securing and/or for displaying a device on a fixture which provides a base to elevate the device from a surface of the fixture.

Moreover, an advantage of the present invention is to provide an apparatus, a system and a method for securing and/or for displaying a device on a fixture which provides a resistor and/or a micro-controller to determine an operating voltage of the device and/or a detachable element of the device.

Additional features and advantages of the present invention are described in, and will be apparent from, the detailed description of the presently preferred embodiments and from the drawings.

DETAILED DESCRIPTION OF THE PREFERRED EMBODIMENTS

Figure 1:
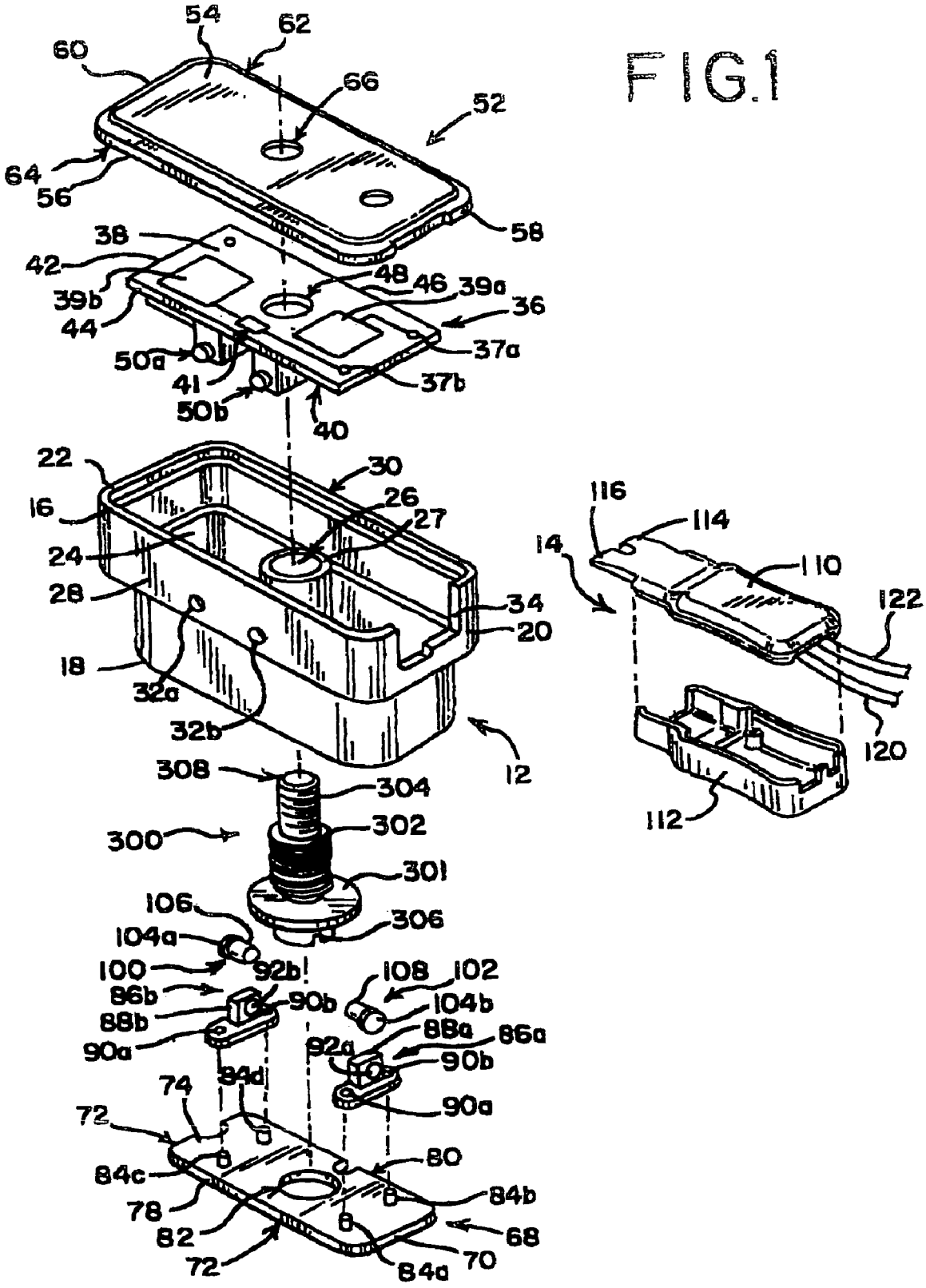
FIG. 1 is an exploded perspective view of a housing with an optical sensor and a sensor board in an embodiment of the present invention.

The present invention relates to an apparatus, a system and a method for securing and/or for displaying a device on a fixture. The apparatus, the system and the method for securing and/or for displaying a device on a fixture may attach and/or may secure the device and/or a detachable element of the device to a fixture. A housing and/or a cable may connect the device and/or the detachable element to the fixture. The housing may have an optical sensor and/or a sensor board with a micro-controller and/or a resistor in communication with the micro-controller. An alarm box and/or an alarm board may be in communication with an optical sensor and/or the micro-controller via a cable. A power source may be in communication with the micro-controller via the cable to control a voltage which may be delivered from the power source to the device. Furthermore, the cable may extend outward with respect to a base, a retracting means and/or the fixture which may allow the device and/or the detachable element of the device to be manipulated and/or to be examined by a customer and/or a user.

Referring now to the drawings wherein like numerals refer to like parts, FIGS. 1-4 illustrate a device 11 and a system 10 which may include an alarm box 2, a power source 3, a housing 12 and/or a connector plug 14. The housing 12 may have a top side 16 and/or a bottom side 18 wherein the bottom side 18 is opposite to the top side 16. The housing 12 may have a first end 20 and/or a second end 22 wherein the second end 22 is opposite to the first end 20.

The housing 12 may have a cavity 24 which may extend inward with respect to the top side 16 of the housing 12. The housing 12 may have an opening 26 which may extend through the housing 12 from the cavity 24 to the bottom side 18. A ring 27 may encircle the opening 26 and/or may extend outward with respect to the cavity 24. The housing 12 may have a front side 28 and/or a back side 30 wherein the back side 30 is opposite to the front side 28.

Figure 2:
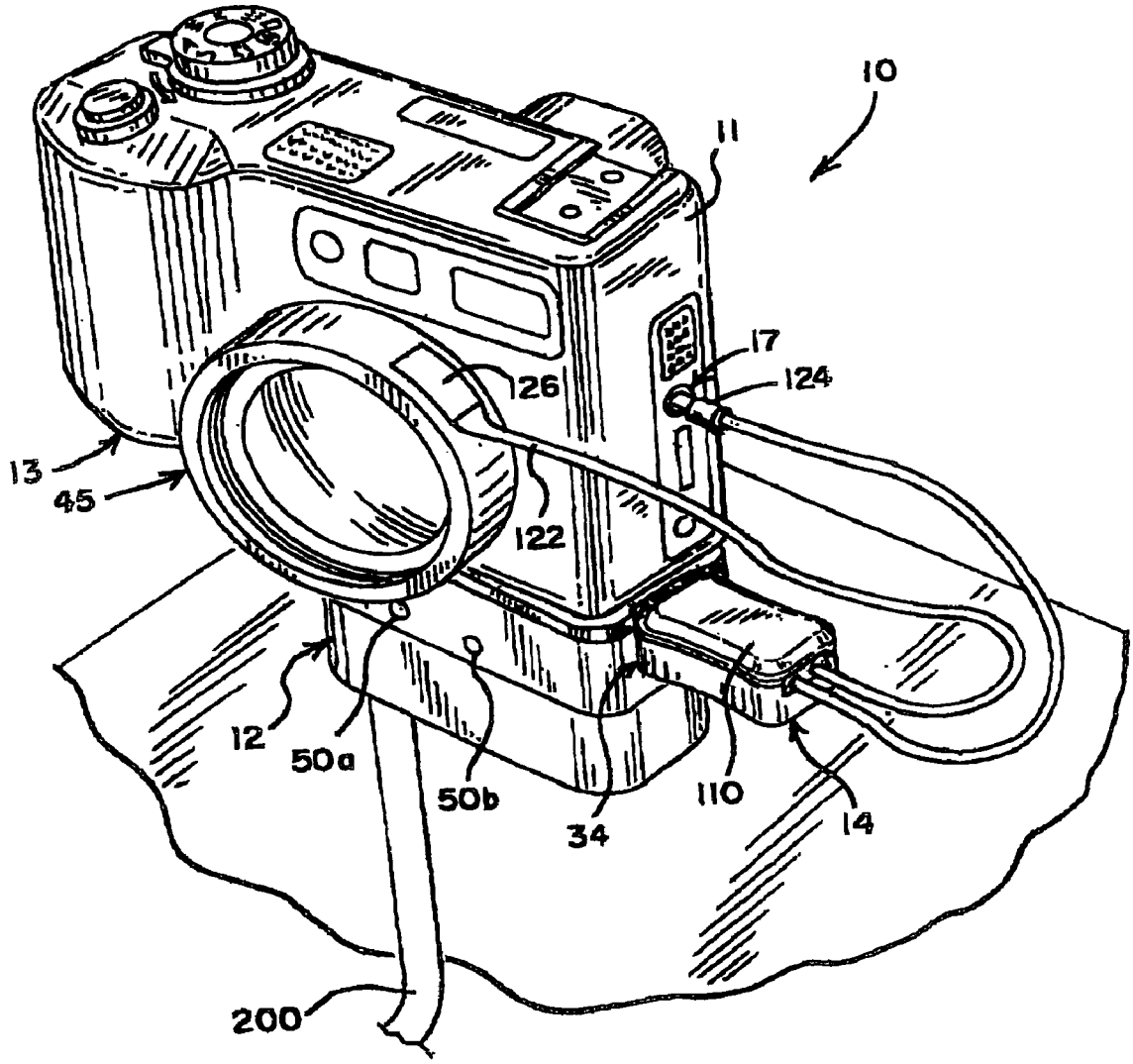
FIG. 2 is a perspective view of the device attached to a housing in an embodiment of the present invention.
Figure 3:
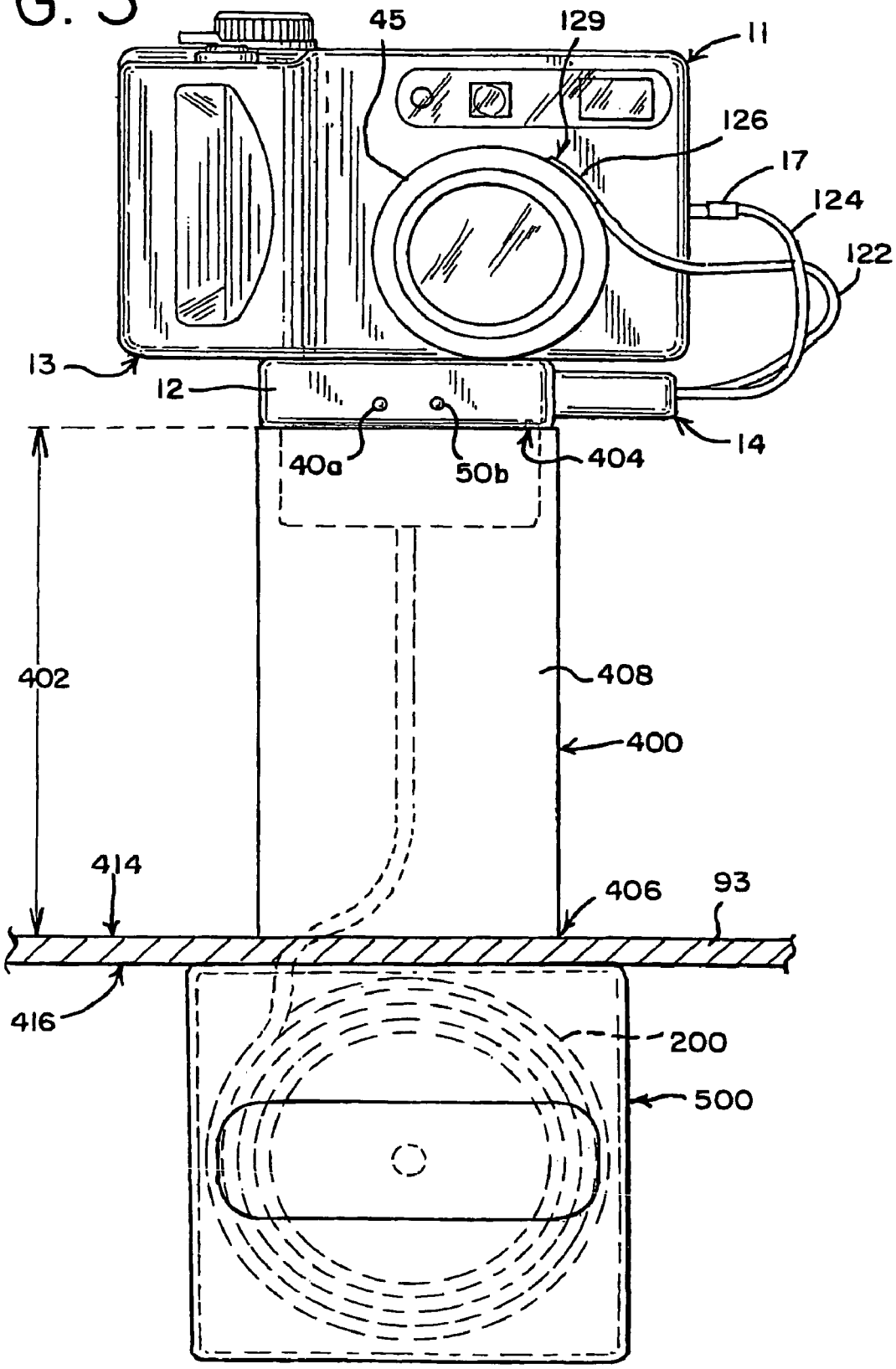
FIG. 3 is a front plan view of a device mounted on a base of a fixture in an embodiment of the present invention.

As illustrated in FIGS. 1-3, the front side 28 of the housing 12 may have a first hole 32*a* and/or a second hole 32*b*. The holes 32*a*, 32*b* may extend through the housing 12 from the cavity 24 to the front side 28 of the housing 12. The first end 20 may have a slot 34 which may extend inward with respect to the top side 16 of the housing 12. The slot 34 may extend through the housing 12 from the first end 20 to the cavity 24 of the housing 12.

As illustrated in FIG. 1, the housing 12 may have a sensor board 36 which may have a top side 38 and/or a bottom side 40 wherein the bottom side 40 is opposite to the top side 38. The sensor board 36 may a first end 43 and/or a second end 42 wherein the second end 42 is opposite to the first end 43. The sensor board 36 may have a front side 44 and/or a back side 46 wherein the back side 46 is opposite to the front side 44. The top side 38 of the sensor board 36 may have a first head 37*a* and/or a second head 37*b* wherein the heads 37*a*, 37*b* may extend inward with respect to the top side 38 of the sensor board 36. The sensor board 36 may have an opening 48 which may extend through the sensor board 36 from the top side 38 to the bottom side 40. The sensor board 36 may include a first light emitting diode (LED) 50*a* and/or a second LED 50*b*. The LEDs 50*a*, 50*b* may be attached to the bottom side 40 of the sensor board 36.

The sensor board 36 may have one or more programmable logical devices, such as, for example, an electrical resistor 41, a first micro-controller 39*a* and/or a second micro-controller 39*b*. The first micro-controller 39*a* and/or the second micro-controller 39*b*, may be attached to and/or may be connected to the sensor board 36. The first micro-controller 39*a* and/or the second micro-controller 39*b* may be in communication with and/or may control the first LED 50*a* and/or the second LED 50*b*. The first head 37*a* and/or the second head 37*b* may be connected to the second micro-controller 39*b* and/or the first micro-controller 39*a*, respectively. As a result, the first head 37*a* and/or the second head 37*b* may be connected to the second LED 50*b* and/or the first LED 50*a*, respectively.

The electrical resistor 41 may be located between, may be attached to and/or may be connected to the second head 37*b* and/or the second micro-controller 39*b* as illustrated in FIG. 1. The electrical resistor 41 may be in series with the second head 37*b* and/or the second micro-controller 39*b*. The electrical resistor 41 may connect the second head 37*b* to the second micro-controller 39*b*.

The cavity 24 of the housing 12 may receive the sensor board 36. The sensor board 36 may be inserted into the cavity 24 of the housing 12 and/or may abut the cavity 24 of the housing 12. The first end 43 of the sensor board 36 may be adjacent to the first end 20 and/or the slot 34 of the housing 12. The first end 43 of the sensor board 36 may abut the slot 34 of the housing 12. The front side 44 and/or the back side 46 of the sensor board 36 may be adjacent to the front side 28 and/or the back side 30, respectively, of the housing 12. The second end 42 of the sensor board 36 may be adjacent to the second end 22 of the housing 12.

The bottom side 40 of the sensor board 36 may abut the ring 27 of the housing 12. The opening 48 of the sensor board 36 may be aligned with the opening 26 of the housing 12. The LEDs 50*a*, 50*b* may be aligned with and/or may be positioned within the holes 32*a*, 32*b*, respectively. As a result, the light emitted by the LEDs 50*a*, 50*b* may emit through the holes 32*a*, 32*b*, respectively. The housing 12 may include a top cover 52 which may have a first side 58 and/or a second side 60 wherein the second side 60 is opposite to the first side 58. The top cover 52 may have a top side 54 and/or a bottom side 56 wherein the bottom side 56 is opposite to the top side 54 of the top cover 52. The top cover 52 may have a front side 64 and/or a back side 62 wherein the back side 62 is opposite to the front side 64 of the top cover 52. The top cover 52 may have an opening 66 which may extend through the top cover 52 from the top side 54 to the bottom side 56.

As illustrated in FIG. 1, the cavity 24 of the base 12 may receive the top cover 52 wherein the top cover 52 may be attached to the housing 12. As a result, the top cover 52 may abut the cavity 24 of the housing 12 and/or may abut the top side 38 of the sensor board 36. The top cover 52 may cover the cavity 24 of the housing 12. As a result, the sensor board 36 may be enclosed by the cavity 24 and/or the top cover 52. The opening 66 of the top cover 52 may be aligned with the openings 48, 26 of the sensor board 36 and the housing 12, respectively.

The housing 12 may include a recession (not shown in the drawing) which may extend inward with respect to the bottom side 18 of the housing 12. The housing 12 may include a bottom cover 68 which may have a first end 70 and/or a second end 72 wherein the second end 72 is opposite to the first end 70. The bottom cover 68 may have a top side 74 and/or a bottom side 76 wherein the bottom side 76 is opposite to the top side 74. The bottom cover 68 may have a front side 78 and/or a back side 80 wherein the back side 80 is opposite to the front side 78 of the bottom cover 68.

The bottom cover 68 may have an opening 82 which may extend through the bottom cover 68 from the bottom side 76 to the top side 74. The opening 82 of the bottom cover 68 may be aligned with the opening 26 of the housing 12. Moreover, the opening 82 of the bottom cover 68 may be aligned with the opening 48 of the sensor board 36 and/or the opening 66 of the top cover 52.

The bottom cover 68 may have a first notch 84*a* and/or a second notch 84*b* which may be adjacent to the first end 70 as illustrated in FIG. 1. The bottom cover 68 may have a third notch 84*c* and/or a forth notch 84*d* which may be adjacent to the second end 72. The notches 84*a*, 84*c* may be adjacent to the front side 78 of the bottom cover 68. The notches 84*b*, 84*d* may be adjacent to the back side 80 of the bottom cover 68. The first notch 84*a* and the second notch 84*b* may extend outward with respect to the top side 74 of the bottom cover 68.

The housing 12 may have a first mount 86*a* and/or a second mount 86*b*. The first mount 86*a* may have a first arm 88*a*. The second mount 86*b* may have a second arm 88*b*. The first mount 86*a* and/or the second mount 86*b* may have a first groove 90*a* and/or a second groove 90*b*. The first arm 88*a* and the second arm 88*b* may have a first opening 92*a* and a second opening 92*b* respectively.

The first notch 84*a* and the second notch 84*b* of the bottom cover 68 may be inserted into the first groove 90*a* and the second groove 90*b*, respectively, of the first mount 86*a*. As a result, the first mount 86*a* may be attached to the bottom cover 68. The first arm 88*a* of the first mount 86*a* may extend outward with respect to the top side 74 of the bottom cover 68.

Figure 6:
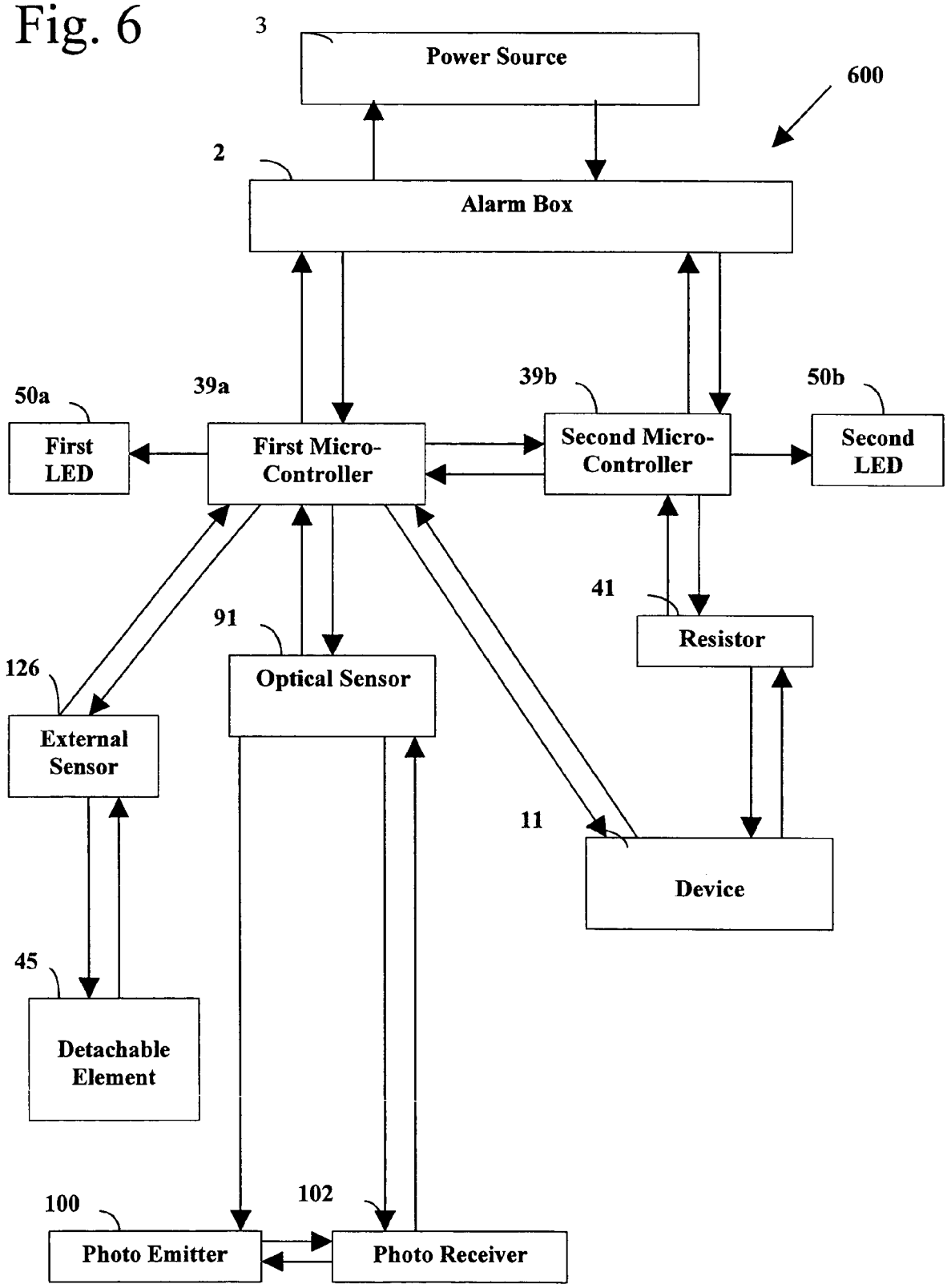
FIG. 6 is a black box diagram of a system in an embodiment of the present invention.

The third notch 84*c* and the forth notch 84*d* of the bottom cover 68 may be inserted into the first groove 90*a* and the second groove 90*b*, respectively, of the second mount 86*b*. As a result, the second mount 86*b* may be attached to the bottom cover 68. The second arm 88*b* of the second mount 86*b* may extend outward with respect to the top side 74 of the bottom cover 68. The housing 12 may have an optical sensor 91 as illustrated in FIGS. 1 and 6. The optical sensor 91 may include a photo emitter 100 and/or a photo receiver 102. The photo emitter 100 may have a first base 104*a* and/or a light emitting source 106. The light emitting source 106 may be, for example, a light emitting diode. The photo emitter 100 may be connected to a power source 3. The power source 3 may provide a voltage to the photo emitter 100 and/or the light emitting source 106.

As illustrated in FIGS. 1 and 3, the voltage from the power source 3 may allow the light emitting source 106 to emit, for example, electromagnetic radiation. The electromagnetic radiation may be at a frequency, such as, for example, a radio frequency, a microwave frequency, an infrared frequency, a visible frequency and/or an ultraviolet frequency. The light emitting source 106 may be made from a material, such as, for example, aluminum gallium arsenide, gallium arsenide, aluminum gallium arsenide phosphide, indium gallium arsenide, and/or the like. It should be understood that the electromagnetic radiation may be at any frequency known to one having ordinary skill in the art. The present invention should not be deemed as limited to the embodiments of a specific material of the light emitting source 106.

The photo receiver 102 may be connected to an alarm box 2 and/or may be connected to the first micro-controller 39*a*. As a result, the optical sensor 91 may be connected to the alarm box 2, the first micro-controller 39*a* and/or the device 11. The photo receiver 102 may have a second base 104*a* and/or a light detector 108. The light detector 108 may receive the electromagnetic radiation which may be emitted from the light emitting source 106 of the photo emitter 100. The light detector 108 may detect the electromagnetic radiation which may be emitted from the light emitting source 106 of the photo emitter 100. As a result, the photo detector 108 may receive and/or may detect the electromagnetic radiation of the photo emitter 100.

As illustrated in FIG. 1, the photo emitter 100 may be inserted into the first opening 92*a* in the first arm 88*a* of the first mount 86*a*. As a result, the photo emitter 100 may be attached to the first mount 86*a* and/or may be connected to the bottom cover 68 of the base 12. The first base 104*a* may abut the first arm 88*a* of the first mount 86*a*. As a result, the light emitting source 106 of the photo emitter 100 may extend inward with respect to the opening 82 of the bottom cover 68.

The photo receiver 102 may be inserted into the second opening 92*b* in the second arm 88*b* of the second mount 86*b*. As a result, the photo receiver 102 may be attached to the second mount 96*b* and/or may be connected to the bottom cover 68 of the base 12. The light detector 108 may extend inward with respect to the opening 82 of the bottom cover 68. As a result, the light receiver 108 may be aligned with the light emitting source 106. Moreover, the light detector 108 may receive and/or may detect the electromagnetic radiation which may be emitted from the light emitting source 106.

Alternatively, the photo emitter 100 may be inserted into the second opening 92*b* in the second arm 90*b* of the second mount 86*b*, and the photo receiver 102 may be inserted into the first opening 92*a* in the first arm 90*a* of the first mount 86*a*. The photo receiver 102 may be attached to the first mount 86*a* and/or the bottom cover 68 of the base 12. The photo emitter 100 may be attached to the second mount 86*b* and/or the bottom cover 68 of the base 12. As a result, the light detector 108 may be aligned with the light emitting source 106. The light detector 108 may detect and/or may receive the electromagnetic radiation from the light emitting source 106.

The light detector 108 may receive and/or may detect the electromagnetic radiation which may be emitted from the light emitting source 106. The electromagnetic radiation transmitted from the light emitting source 106 to the light receiver 108 may be continuous and/or constant and/or uniform and/or uninterrupted. The frequency of the electromagnetic radiation transmitted from the light emitting source 106 to the light detector 108 may be constant and/or continuous.

The device 11 may be a portable electronic device, such as, for example, a camera, a camcorder, a digital camera, a digital music player, a video game, a digital video player, a digital video recorder, a personal data assistant (hereinafter "a PDA"), a cellular telephone and/or the like. Further, the device 11 may have an underside 13 and/or a mounting hole (not shown in the drawings). The mounting hole may be adapted to receive, for example, a screw and/or a pin from, for example, a tripod mount. As a result, the device 11 may be mounted on, for example, a tripod. The present invention should not be deemed as limited to the embodiments of a specific portable device.

The device 11 may have a detachable element 45 attached thereon. The detachable element 45 of the device 11 may be, for example, a camera lens, an ear piece, head phones, a head set, a wireless head set, a battery, a speaker, a case to hold the device therein and/or the like. For example, the device 11 may be a digital camera and the detachable element 45 may be, for example, a digital camera lens, a digital camera filter a memory card, battery cover, a lens cover, a wireless adaptor, a remote control and/or the like. Alternatively, the device 11 may be a cellular telephone and the detachable element 45 may be, for example, a headset, a battery cover, a wireless head set, a data transfer adapter, a hands-free headset, a wireless speaker and/or the like. In another embodiment, the device 11 may be a PDA and the detachable element 45 may be, for example, a personal computer card, a wireless adapter, a battery cover, ear plugs, a wireless headset, a keyboard, an expansion card, a media card and/or the like. The present invention should not be deemed as limited to a specific embodiment of the device 11 and/or the detachable element 45.

As illustrated in FIG. 2, the device 11 may have a direct current plug-in 17 (hereinafter "DC plug-in 17"). The device 12 may require an operating voltage, such as, for example, three volts, five volts and/or the like. Each type of portable device may require a specific operating voltage. For example, a portable compact disc player may have an operating voltage of 4.5 volts, a cellular telephone may have an operating voltage of seven volts, and a digital camera may have an operating voltage of six volts. Further, the device 11 may require an operating current, such as, for example, a direct current. Moreover, the present invention should not be deemed as limited to the embodiments of a specific operating voltage and/or a specific operating current of the device 11.

The housing 12 may be attached and/or may be connected to the fixture 93 with the cable 200. The fixture 93 may be, for example, a wall, a floor, a pillar, a support beam, a stair case or a fixture, such as, for example, a cabinet, a table, a shelf and/or the like. The present invention should not be deemed as limited to the embodiments of a specific structural element and/or a specific fixture 48.

As illustrated in FIGS. 1 and 2, a connector plug 14 may be inserted into the housing 12. The connector plug 14 may have a top element 110 and/or a bottom element 112. The top element 110 may be inserted into the bottom element 112. As a result, the top element 110 may be attached to the bottom element 112. The top element 110 may have a first flange 114 and/or a second flange 116. The first flange 114 and/or the second flange 116 may extend outward with respect to the top element 110 and/or the bottom element 112. The top element 110 may have, for example, a circuit board (not shown in the drawing) which may be attached to the first flange 114 and/or the second flange 116.

The connector plug 14 may include a first cord 120 and/or a second cord 122. The first cord 120 and/or the second cord 122 may be attached to the circuit board of the top element 110. As a result, the first cord 120 and/or the second cord 122 may be connected to the first flange 114 and/or the second flange 116, respectively. The first cord 120 may have, for example, a voltage plug 124. The second cord 122 may have an exterior sensor 126. The voltage plug 124 and/or the attaching means 126 may be opposite to the connector plug 14.

Figure 4:
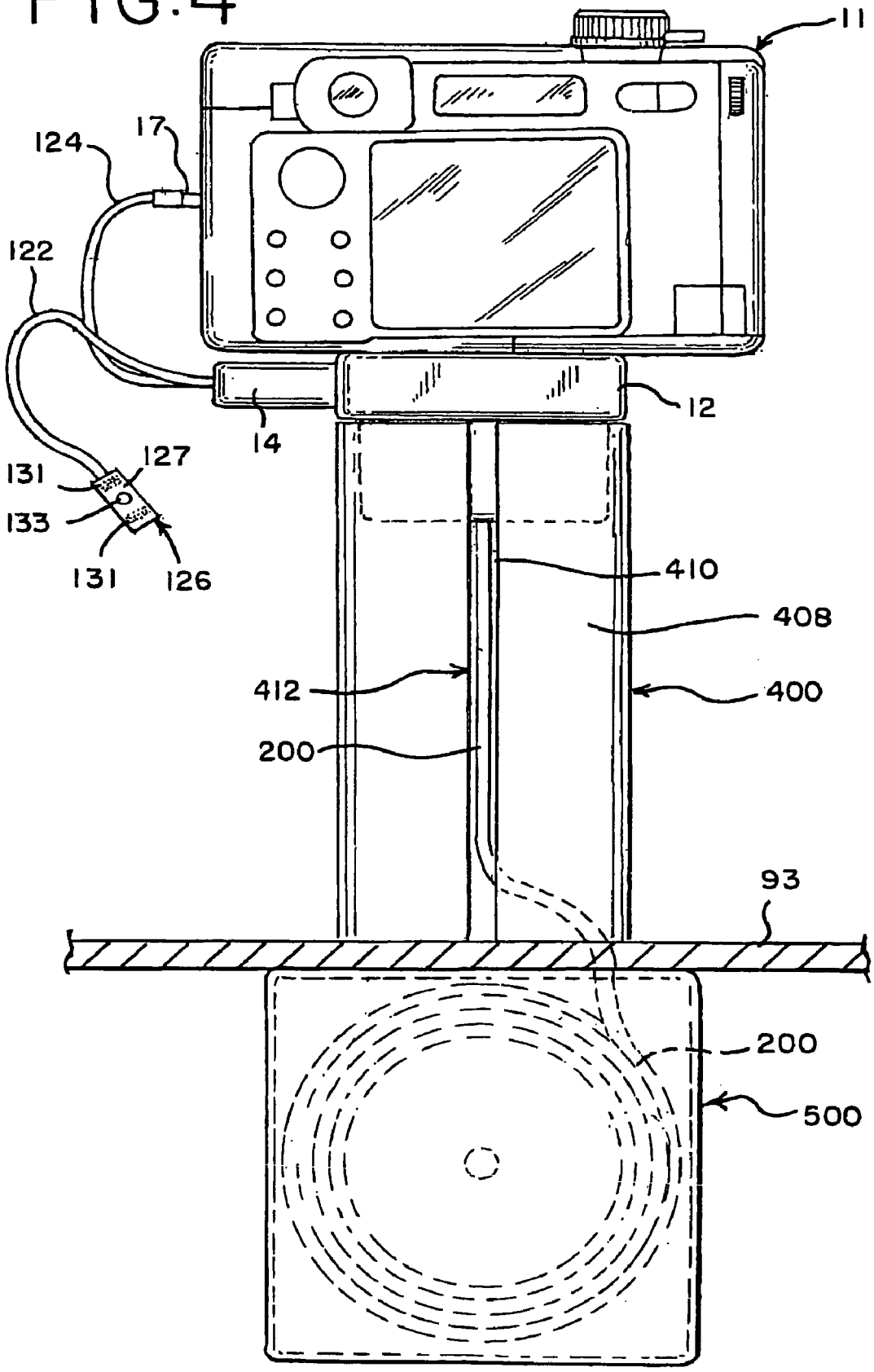
FIG. 4 is a rear plan view of a device mounted on a base of a fixture in an embodiment of the present invention.
Figure 5:
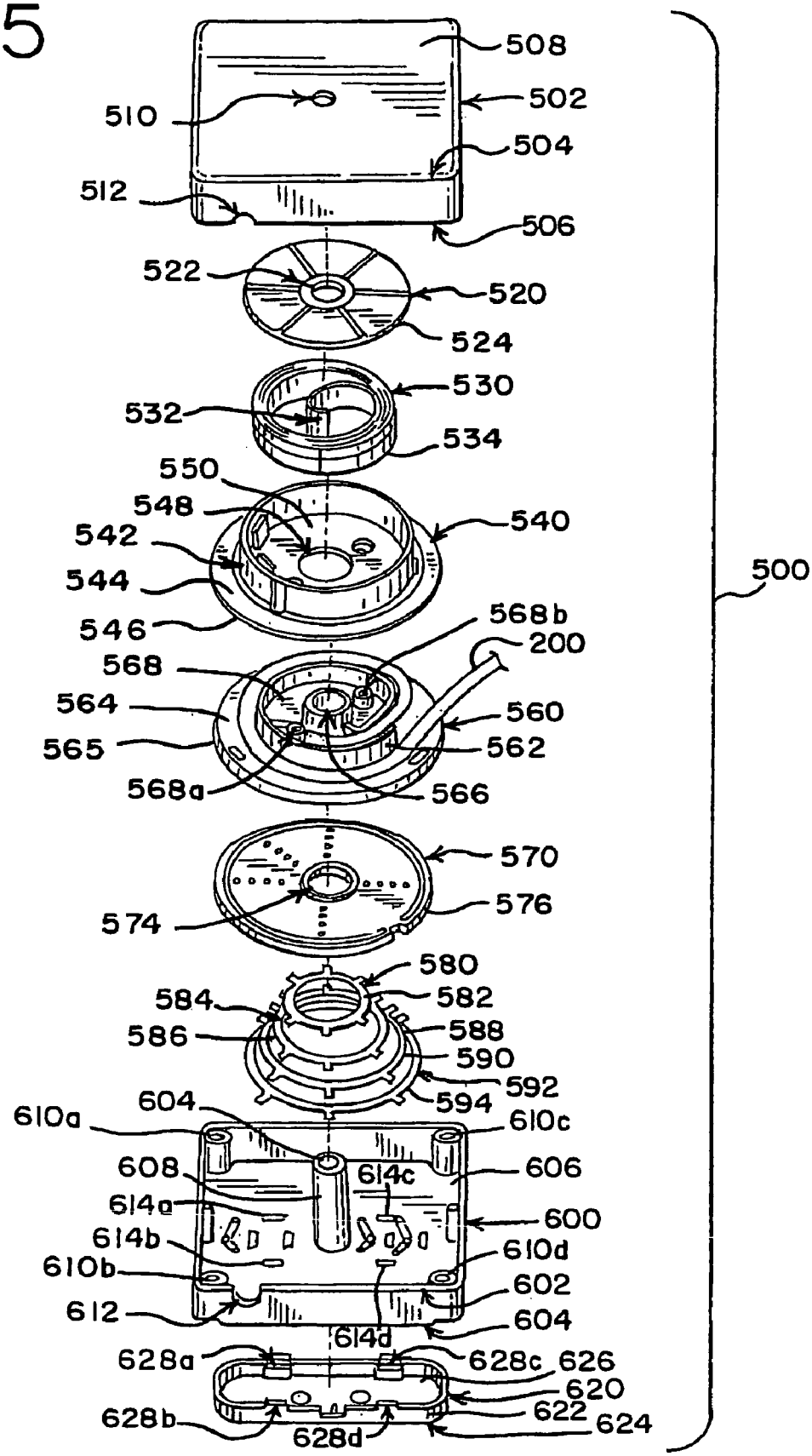
FIG. 5 is an exploded view of a retracting means with a cable in an embodiment of the present invention.

As illustrated in FIG. 4, the external sensor 126 may have a first side 127 and a second side 129 wherein the second side 127 is opposite to the first side 127. The first side 127 of the exterior sensor 126 may have an adhesive 131 and/or a plunger 133. Alternatively, the external sensor may be magnetized for attachment to the detachable element 45 of the device 11. The plunger 133 may extend outward with respect to the first side 127. The plunger 133 may be attached to a plunger switch (not shown in the drawings) which may be inside of the exterior sensor 126.

The first flange 114 and/or the second flange 116 may be inserted into the slot 34 of the housing 12. As a result, the connector plug 14 may be connected and/or may be attached to the housing 12. The first flange 114 and/or the second flange 116 may abut and/or may contact the first head 37*a* and/or the second head 37*b*, respectively. As a result, the connector plug 14 may be connected to the first head 37*a* and/or the second head 37*b*. The first flange 114 and/or the second flange 116 may be connected to the first micro-controller 39*a* and/or the second micro-controller 39*b*, respectively. The first cord 120 and/or the second cord 122 may be connected to the first micro-controller 39*a* and/or the second micro-controller 39*b*, respectively. As a result, the external sensor 126 may be connected to and/or in communication with the first micro-controller 39*a*. Furthermore, the plunger 133 and/or the plunger switch may be connected to and/or may be in communication with the first micro-controller 39*a*. As a result, the external sensor 126 and/or plunger 133 is connected to the alarm box 2.

As illustrated in FIGS. 2 and 3, the first side 127 of the exterior sensor 126 may abut the detachable element 45 of the device 11. The adhesive 131 of the first side 127 may adhere to the detachable element 45. Alternatively, the detachable element 45 may be attached to the exterior sensor 126 by the magnetism of the exterior sensor 126. As a result, the adhesive 131 and/or the exterior sensor 126 may be attached to the detachable element 45. The detachable element 45 of the device 11 may depress the plunger 133 into the exterior sensor 126 and/or may push the plunger 133 inward with respect to the first side 127 of the exterior sensor 126. The plunger switch may be activated by the plunger. The plunger switch may be in communication with the first micro-controller 39*a* and/or the first flange 114 of the connector plug 14. The detachable element 45 of the device may be connected to the device 11, the alarm box 2, the fixture 93, the cable 200 and/or the first micro-controller 39*a* as illustrated in FIG. 6. As a result, the detachable element 45 may be secured to the fixture 93 via the cable 200, the housing 12 and/or the alarm box 2.

The cable 200 may include one or more wires, such as, for example, an electrical wire or wires and/or a mechanical wire or wires. The cable 200 may provide a number of electrical pathways between the optical sensor 91, the photo emitter, 100, the photo receiver 102, the first micro-controller 39*a*, the second micro-controller 39*b*, the connector plug 14, the external sensor 126 and/or sensor board 36 and the alarm box 2 and/or the power source 3. The number of electrical pathways may be determined by a number of electrical signals that may be communicated between the optical sensor 91, the photo emitter 100, the photo receiver 102, the first micro-controller 39*a*, the second micro-controller 39*b*, the connector plug 14, the external sensor 126, the device 11 and/or the sensor board 36 and the alarm box 2 and/or the power source 3. For example, the cable 200 may provide, for example, three electrical pathways, such as, for example, a voltage pathway, a data transmission pathway and/or an alarm signal pathway between the optical sensor 91, the photo emitter 100, the photo receiver 102, the first micro-controller 39*a*, the second micro-controller 39*b*, the connector plug 14, the external sensor 126, the device 11 and/or the sensor board 36 and the alarm box 2 and/or the power source 3. The cable 200 may transmit, for example, power, a voltage, a current, a communication signal, a video-signal, and/or an audio-signal between the optical sensor 91, the photo emitter 100, the photo receiver 102, the first micro-controller 39*a*, the second micro-controller 39*b*, the connector plug 14, the external sensor 126, the device 11 and/or the sensor board 36 and the alarm box 2 and/or the power source 3. Further, the cable 200 may transmit, for example, power from the power source 3 to the device 11. Still further, the cable 200 may transmit, for example, a video-signal and/or an audio-signal received from the device 11. The cable 200 may be made from a material, such as, for example, copper and/or the like. The present invention should not be deemed as limited to the embodiments of a specific material of the mechanical wire or a specific number of electrical pathways provided by the cable 200.

As illustrated in FIGS. 2 and 6, the cable 200 may connect the alarm box 2 and/or the power source 3 to the photo emitter 100, the photo receiver 102, the first micro-controller 39*a*, the second micro-controller 39*b*, the device 11 and/or the sensor board 36. The cable 200 may be fastened to the housing 12. Further, the cable 200 may be connected to the light emitting source 106 and/or the light detector 108. The cable 200 may be attached to the alarm box 2 and/or the power source 3. As a result, the alarm box 2 and/or the power source 3 may be in communication with the optical sensor 91, the photo emitter 100, the photo receiver 102, the first micro-controller 39*a*, the second micro-controller 39*b*, the connector plug 14, the external sensor 126, the device 11, the detachable element 45 of the device 11 and/or the sensor board 36.

The device 11 may be positioned on the top side 54 of the top cover 52 of the housing 12. The underside 13 of the device 11 may be adjacent to and/or may abut the top side 54 of the top cover 52 of the housing 12. The mounting hole may be aligned with the opening 66, the opening 48, and the opening 82 of the top cover 52, the sensor board 36 and the bottom cover 68, respectively. As a result, the mounting hole may be aligned with the opening 26 of the housing 12.

As illustrated in FIG. 1, the system 10 may have a screw 300, a washer 301 and/or a spring 302. The screw 300 may include grooves 304, a base 306 and/or a tip 308. The spring 302 may be positioned around the grooves 304 of the screw 300. The spring 302 may be positioned between the tip 308 and the base 306 of the screw 300. The washer 301 may be positioned around the grooves 304 between the tip 308 and the base 306 of the screw 300. The screw 300 and the spring 302 may be inserted into the base 12. The grooves 304 of the screw 300 may be inserted into the opening 26, the opening 48, the opening 66 and/or the mounting hole of the device 11, the sensor board 36, the top cover 52 and/or the device 11, respectively. The base 306 of the screw 300 may be positioned in the housing 12 and/or the tip 308 of the screw 300 may abut the device 11. The grooves 304 of the screw 300 may extend into the device 11 and/or the screw 300 may be attached to the device 11. As a result, the device 11 is attached to the housing 12, the cable 200, the alarm box 2 and/or the power source 3. The bottom cover 68 may be attached to the bottom side 18 of the housing 12. The head 306 of the screw 300 may be enclosed by the housing 12 and the bottom cover 68. As a result, the screw 300 may not be removed from the housing 12 without removing the bottom cover 68 of the housing 12.

The voltage plug 124 may be inserted into the DC plug-in 17 of the device 11 and/or may be connected to the second micro-controller 39*b* and/or the power source 3 as illustrated in FIGS. 2-4. As a result, the device 11 may be in communication with the electrical resistor 41 and/or the second micro-controller 39*b*. The second micro-controller 39*b* may be programmed to determine the required operational voltage of the device 11 via the electrical resistor 41 and/or the DC plug-in 17 of the device 11. The second micro-controller 39*b* may communicate with the device 11 and/or may communicate the required operational voltage of the device 11 to the power source 3. The power source 3 may be programmable and/or may determine the required operational voltage of the device 11 via the second micro-controller 39*b*. The power source 3 and/or the second micro-controller 39*b* may deliver the required operational voltage to the device 11 via the cable 200, the electrical resistor 41, the first cord 120, the voltage plug 124 and/or the DC plug-in 17.

In another embodiment, the second micro-controller 39*b* may be programmed with the required operational voltage of the device 11. The second micro-controller 39*b* may control the voltage emitted by the power source 3. Further, the power source 3 may provide the required operational voltage to the device 11 via the cable 200, the first cord 120, the second micro-controller 39*b*, the voltage plug 124 and/or the DC plug-in 17. As a result, the second micro-controller 39*b* may allow the device 11 to be activated and/or to be operated.

The first LED 50*a* may emit a color, such as, for example, red. The first micro-controller 39*a* may be programmed to control the first LED 50*a*. The second micro-controller 39*b* and/or the power source 3 may be connected to the second LED 50*b*. The second micro-controller 39*b* and/or the power source 3 may control the second LED 50*b*. The second LED 50*b* may emit a color, such as, for example, green. The power source 3 and/or the second micro-controller 39*b* may activate the second LED 50*b* to indicate that the voltage is being supplied to the device 11 and/or that the device 11 has been activated. The first LED 50*a* and/or the second LED 50*b* may emit light which may be visible through the first hole 32*a* and/or the second hole 32*b*, respectively. The present invention should not be deemed as limited to the color emitted by the first LED 50*a* and/or the second LED 50*b*.

The device 11 may, therefore, be activated with the required operational voltage. The required operational voltage may be provided to the device 11 from the power source 3 via the cable 200, the first cord 120, the second micro-controller 39*b*, the voltage plug 124 and/or the DC plug-in 17. The second LED 50*b* may be activated to indicate that the power source 3 is supplying the required operational voltage to the device 11. Further, the second LED 50*b* may be activated by the second micro-controller 39*b* to indicate that the device 11 has been activated. Alternatively, the power source 3 may activate the second LED 50*b* to indicate that the second micro-controller 39*b* may be receiving the output voltage from the power source 3 via the cable 200.

As illustrated in FIGS. 1-4, the device 11 may be, for example, a digital camera and/or the detachable element 45 may be, for example, a detachable camera lens. The external sensor 126 may be attached to and/or may be connected to the detachable element 45 of the device 11 by, for example, the adhesive, the magnetism, and/or the like. Depressing the plunger 133 with the detachable element 45 may close a circuit within the plunger switch, the connector plug 14 and/or the first micro-controller 39*a*. As a result, the first micro-controller 39*a* may activate the first LED 50*a* to indicate that the detachable element 45 is secured to the connector plug 14 and/or the housing 12.

The external sensor 126, the plunger 133 and/or the plunger switch may detect removal of and/or separation of the detachable element 45 of the device 11 from the external switch 126, the device and/or the housing 12. The first micro-controller 39*a* may deactivate the first LED 50*a* to indicate that the detachable element 45 is detached from the external sensor 126, the housing 12 and/or the device 11. The first micro-controller 39*a* may signal the alarm box 2 that the detachable element 45 is detached from the external sensor 126, the housing 12 and/or the device 11. As a result, the alarm box 2 may be activated and/or may produce an audio signal.

The photo emitter 100 and/or the light emitting source 106 may be in communication with the power source 3 and/or the alarm box 2. The photo emitter 100 and/or the light emitting source 106 may be controlled by the alarm box 2 and/or the power source 3. The screw 300 may be inserted into the opening 82 of the bottom cover 68 of the base 12. Attaching the screw 300 and/or the housing 12 to the device 11 may activate the photo emitter 100 and/or the photo receiver 102. As a result, the light emitting source 106 may be activated and/or may transmit electromagnetic radiation to the light detector 108. The light detector 108 may receive, may monitor and/or may detect the electromagnetic radiation from the light emitting source 106. The light detector 108 may be in communication with the alarm box 2 and/or may provide a signal indicate to the alarm box 2 that the light detector 108 may be receiving electromagnetic radiation from the light emitting source 106.

As illustrated in FIG. 6, a system 600 may have the photo receiver 102 and/or the light detector 108 which may be in communication with the alarm box 2 to indicate that the light detector 108 is receiving and/or is detecting electromagnetic radiation emitted from the light emitting source 106. The electromagnetic radiation from the light emitting source 106 may be interrupted and/or may be impeded by a condition. The condition may prevent the light detector 108 from receiving the electromagnetic radiation from the light emitting source 106. The condition interrupting the electromagnetic radiation may occur momentarily or may occur indefinitely. Alternatively, the condition may not entirely interrupt the electromagnetic radiation from the light emitting source 106.

The condition may relate to detaching, separating and/or unsecuring the device 11 from the housing 12, the fixture 93, the cable 200 and/or the alarm box 2. The screw 300 and/or the screw 302 may be positioned inside the housing 12. The spring 302 may be positioned between the head 306 of the screw and the housing 12. As a result, the spring 302 may be compressed between the head 306 of the screw 300 and the housing 12. The screw 300 may extend outward with respect to the housing 12 and may attach the device 11 to the housing 12, the alarm box 2, the power source 3 and/or the cable 200. As a result, the device 12 may be secured to the housing 12, the alarm box 2, the power source 3 and/or the cable 200.

A theft of the device 11 may separate the device 11 from, may remove the device 11 from and/or may separate the device 11 from the housing 12, the spring 300, the fixture 93 and/or the alarm box 2. As a result, the screw 300 and/or the spring 302 may be detached from the device 11. The spring 302 may decompress and/or may force the screw 300 inward with respect to the top cover 54. The spring 302 may force the head 306 of the screw 300 inward with respect to the top side 74 of the bottom cover 68. The head 306 of the screw 300 may abut the top side 74 of the bottom cover 68. As a result, the screw 300, the head 306 of the screw 300 and/or the washer 301 may move inward with respect to the bottom cover 68. The screw 300, the head 306 of the screw 300 and/or the washer 301 may be positioned between the light emitting source 106 and the light detector 108 after being detached from the device 11. The screw 300, the head 306 of the screw 300 and/or the washer 301 may interrupt the electromagnetic radiation received by the light detector 108 from the light emitting source 106. As a result, the condition may occur because the screw 300, the head 306 of the screw 300 and/or the washer 301 has interrupted the electromagnetic radiation.

The condition may relate to inserting a tool (not shown in the drawings) into the opening 82 of the bottom cover 68. The tool may be, for example, a screw driver, a wrench, a wire and/or the like. The tool may be inserted into the opening 82 of the bottom cover 68 to engage and/or to remove the screw 300 from the device 11 and/or the housing 12 in an attempt to steal the device 11. The tool may extend inward with respect to the housing 12. As a result, the tool may be inserted between the light emitting source 106 and the light detector 108. The tool may interrupt the electromagnetic radiation received by the light detector 108 from the light emitting source 106. As a result, the condition may occur because the tool interrupts the electromagnetic radiation between the light detector 108 and the light emitting source 106.

The condition may prevent the photo receiver 102 and/or the light detector 108 from detecting the electromagnetic energy emitted from the light emitting source 106. The photo receiver 102 and/or the light detector 108 may provide a signal to the alarm box 2 that the condition has occurred. As a result, the alarm box 2 may be activated and/or may produce the audio signal. The first micro-controller 39*a*, the optical 91, the photo emitter 100, the photo receiver 102, the light emitting source 106, the light detector 108, the power source 204, the alarm box 202 and/or the cable 200 may electrically secure the device 11. As a result, the alarm box 2 may produce the audio signal which may indicate that electromagnetic radiation has been interrupted and/or that the device 11 is unsecured.

As illustrated in FIG. 6, the external sensor 126 may communicate to the first micro-controller 39*a* if the detachable element 45 of the device 11 has been removed from the external sensor 126 and/or if the circuit formed by the external sensor 126 and the detachable element 45 has been broken by, for example, snipping and/or cutting the cord 122. The second micro-controller 39*b* may detect that the voltage plug 124 has been removed from the device 11. The first micro-controller 39*a* and/or the second micro-controller 39*b* may communicate to the alarm box 2 that the second cord 122 and/or the first cord 120, respectively, are separated from the device 11. As a result, the first micro-controller 39*a* and/or the second micro-controller 39*b* may de-activate the first LED 50*a* and/or the second LED 50*b*, respectively. The first micro-controller 39*a* and/or the micro-controller 39*b* may signal the alarm box 2. The alarm box 2 may be activated and/or may produce the audio signal which may indicate that the first cord 120 and/or the second cord 122 may have been removed from the device 11 and/or the detachable element 45 and/or that the device 11 and/or the removable attachment 45 may be unsecured. A user (not shown in the drawings) and/or a customer (not shown in the drawings) may examine, may inspect and/or may utilize the device 11 which may be attached to the cable 200. As a result, the user and/or the customer may move the device 11 allowing examination and/or inspection of the device 11, the detachable element 45. The user may examine and/or may inspect, for example, a weight of the device 11 and/or the detachable element 45, a configuration of the device 11 and/or the detachable element 45, a texture of an exterior of the device 11 and/or the detachable element 45 and/or the like. As a result, a user having a disability, such as, for example, being confined to a wheelchair may be permitted to examine and/or to inspect the device 11 and/or the detachable element 45 which may be attached to the cable 200. Moreover, the device 11 and/or the detachable element 45 may remain electrically and/or mechanically secured to the housing 12, the alarm box 2 and/or the fixture 93 via the cable 200 as the device 11 and/or the detachable element 45 may be examined and/or inspected. The user may activate and/or may utilize the device 11 and/or the detachable element 45 to perform the functions provided by the device 11. For example, the device 11 may be a digital camera and the user may use the device 11 to perform the function of capturing an image (not shown in the drawings). As a result, the device 11 may display the image thereon. The user may examine and/or inspect the image captured by the device 11.

As illustrated in FIGS. 1-3, the system 10 may be attached to the device 11 and/or the detachable element 45 to secure the device 11 and/or the detachable element 45 to the housing 12, the alarm box 2 and/or the fixture 93 via the cable 200. Further, the system 10 may connect the device 11 to the alarm box 2 and/or the power source 3 via the sensor board 36, the housing 12, the cable 200, the first micro-controller 39*a*, the second micro-controller 39*b*, the photo emitter 100 and/or the photo receiver 102. The second micro-controller 39*b* of the sensor board 36 may be in communication with the first micro-controller 39*a* via the sensor board 36. Still further, the device 11 and/or the detachable element 45 may be monitored by the alarm box 2, the optical sensor 91, the first micro-controller 39*a*, the second micro-controller 39*b* and/or the cable 200. The second micro-controller 39*b* and/or the first micro-controller 39*a* may control the voltage delivered from the power source 3 to the device 11. Moreover, the first LED 50*a* and/or the second LED 50*b* of the sensor board 36 may indicate that the alarm box 2 may have been activated and/or that power is provided to the device 11, respectively. The cable 200 and/or the housing 12 may allow the device 11 to be manipulated, to be examined and/or to be utilized by a customer and/or a user. Furthermore, it should be understood that the alarm box 2 and/or the power source 3 may be in communication with more than one device 11, the external sensor 126 the first micro-controller 39*a*, the second micro-controller 39*b*, the sensor board 36, the base 12, the power source 3 and/or the cable 200.

The system 10, the housing 12 and/or the screw 300 may secure the device 11 and/or that the alarm box 2 may have been activated with the optical sensor 91. As a result, the device 11 and/or that the alarm box 2 may have been activated may be secured to the fixture 93 via the cable 200. The photo emitter 100 and/or the photo receiver 102 of the optical sensor 91 may be in communication with the alarm box 2 and/or the power source 3 via a cable 200 to secure the device 11 and/or that the alarm box 2 may have been activated. The housing 12 may have the first LED 50*a* and/or the second LED 50*a* to indicate that the device 11 and/or the removable attachment 45 may be separated from the housing 12 and/or to indicate that a voltage may be provided to the device 11, respectively. As a result, the system 10, the external sensor 126 and/or the optical sensor 91 may electronically secure and/or may mechanically secure the device 11 and/or to indicate that a voltage may be provided to the device 11 of the device 11 to the fixture 93.

As illustrated in FIGS. 3 and 4, the device 11 may be displayed on the fixture 93 in conjunction with a base 400. The base 400 may have a length 402 defined between a top end 404 and a bottom end 406 wherein the bottom end 406 is opposite to the top end 404. illustrate a system 10 which may have a device 12 mounted to a sensor board 14. The device 12 and/or the sensor board 14 may The alarm box 22 may contain an alarm connector 19, an alarm board 21 and/or a power source 24. The power source 24 may plug into a wall socket (not shown) to provide the power source 24 with an incoming voltage, such as, for example, 110 volts and/or an incoming current, such as, for example, an alternating current.

The device 12 may be a portable device, such as, for example, a camera, a digital camera, a compact disc player, a MP3 player, a PDA, a laptop computer, a cellular telephone and/or the like. Further, the device 12 may have an underside 26 and/or a mounting hole 28. The mounting hole 28 may be adapted to receive, for example, a screw from a tripod mount. As a result, the device 12 may be mounted on a tripod.

The device 12 may have a direct current plug-in 30 (hereinafter "DC plug-in 30") and/or a video out-line 31. The video out-line 31 may transmit video signals generated by the device 12 to, for example, a video monitor 112 and/or the like. The device 12 may require an operating voltage, such as, for example, three volts, five volts and/or the like. Each type of portable device may require a specific operating voltage. For example, a portable compact disc player may have an operating voltage of 4.5 volts, a cellular telephone may have an operating voltage of seven volts and a digital camera may have an operating voltage of six volts. Further, the device 12 may require an operating current, such as, for example, a direct current. Moreover, the present invention should not be deemed as limited to the embodiments of a specific portable device and/or a specific operating voltage of the device 12.

The base 16 may have a length 46 between a first end 32 and a second end 34. Further, the base 16 may have an interior 38 and an exterior 36. Still further, the base 16 may have a fixed end 40 and a movable end 42 which may be adjacent to the first end 32 and the second end 34, respectively. A pair of mounts 44 may attach the fixed end 40 to the interior 38 of the base 16. The movable end 42 may move between the fixed end 40 and the second end 34 within the interior 38 of the base 16. The first end 32 may have a first opening 41. A second opening 43 may be located between the first end 32 and the second end 34. The first opening 41 and/or the second opening 43 may extend from the interior 38 to the exterior 36 of the base 16. The length 46 may be, for example, two feet. Moreover, the base 16 and/or the exterior 36 of the base 16 may be attached to and/or may be mounted to a fixture 48. The fixture 48 may be, for example, a table, a cabinet, a shelf and/or the like. The present invention should not be deemed as limited to the embodiments of a specific length 46 and/or a specific fixture 48.

As illustrated in FIGS. 1, 3 and 4, the fixed end 40 may contain a programmable power supplier 108 and/or a programmable logical device, such as, for example, a first micro-controller 23. The alarm connector 19 may connect the first micro-controller 23 and/or the programmable power supplier 108 to the alarm box 22, the alarm board 21 and/or the power source 24. The first micro-controller 23 may control the programmable power supplier 108. The programmable power source 108 may convert the incoming current from the power source 24 to, for example, a direct current. Still further, the first micro-controller 23 may control an output voltage of the programmable power source 108. The programmable power source 108 may provide the output voltage between, for example, two volts and fifteen volts. Moreover, the first micro-controller 23 may control and/or may operate the alarm box 22. The first micro-controller 23 may be programmed to provide the required operational voltage to the device 12 from the power source 24 via the programmable power supplier 108 and/or the cable 20.

The movable end 42 may have an arm 50 extending inward with respect to the fixed end 40. A pulley 52 may be attached to the arm 50 in a position opposite to the movable end 42. A roller 54 may be located within the interior 38 of the base 16. The roller 54 may be adjacent to the fixed end 40 of the base 16. Moreover, the pulley 52, the roller 54 and/or the arm 50 may be located between the movable end 42 and the fixed end 40 of the base 16.

The cable 20 may extend from the first micro-controller 23 to an end 58. Further, the cable 20 may have a plurality of electrical wires 60 and/or a mechanical cable 61. The plurality of electrical wires 60 and/or the mechanical cable 61 may extend from the first micro-controller 23 to the end 58. The mechanical cable 61 may be made from a material, such as, for example, steel and/or the like.

The plurality of electrical wires 60 may provide a number of electrical pathways between the first micro-controller 23 and the end 58 of the cable 20. The number of electrical pathways may be determined by a number of electrical signals being communicated between the first micro-controller 23 and a second micro-controller 94. For example, the plurality of electrical wires 60 may provide, for example, three electrical pathways, such as, for example, a voltage pathway, a video-signal pathway and an alarm signal pathway between the microprocessor 23 and the micro-controller 94. The plurality of electrical wires 60 may transmit, for example, power, a communication signal, a video-signal, and/or an audio-signal between the first micro-controller 23 and the micro-controller 94. Further, the plurality of electrical wires 60 may transmit, for example, power from the programmable power supplier 108 to the device 12. Still further, the plurality of electrical wires 60 may transmit, for example, a video-signal and/or an audio-signal from the device 12 to the video monitor 112. The plurality of electrical wires 60 may be made from a material, such as, for example, copper and/or the like. The present invention should not be deemed as limited to the embodiments of a specific material of the mechanical wire 61 or a specific number of electrical pathways provided by the plurality of electrical wires 60.

As illustrated in FIGS. 1 and 4, the fixed end 40 may have a connector cable 116 extending outward from the exterior 36 of the base 16 via a side hole 118. The connector cable 116 may connect the alarm box 22, the alarm board 21 and/or the power source 24 to the first micro-controller 23 and/or a plurality of second micro-controllers 94*a*, 94*b*, 94*c*, 94*d*. The connector cable 116 may be attached to the alarm box 22 via the alarm connector 19. The connector cable 116 may connect a number, such as, for example, four, eight, twelve or twenty of the second micro-controllers 94 to the alarm box 22, the alarm board 21 and/or the power source 24. The plurality of second micro-controllers 94*a*, 94*b*, 94*c*, 94*d* may be connected to a plurality of devices 12*a*, 12*b*, 12*c*, 12*d*, respectively. Furthermore, it should be understood that the alarm box 22, the alarm board 21 and/or the power source 24 may be in communication with any number of the devices 12, the sensor boards 14, the bases 16, the first micro-controllers 23, the programmable power suppliers 108 and/or the cables 20.

A supply cable 56 may connect the alarm box 22, the alarm board 21 and/or the power source 24 to the first micro-controller 23, the programmable power supplier 108 and/or the cable 20. Further, the supply cable 56 may be attached to the alarm board 21, the alarm box 22 and/or the power source 24 via the alarm connector 19. Still further, the cable 20, the plurality of electrical wires 60 and/or the device 12 may be connected to the alarm box 22 and/or the alarm board 21. The plurality of electrical wires 60 may contain a pair of electrical wires which may be attached to the programmable power supply 108 and/or may deliver a voltage to the device 12. The plurality of wires 60 may contain a pair of communication wires connecting the second micro-controller 94 to the first micro-controller 23. The plurality of wires 60 may contain a pair of video-signaling wires connecting the video out-line 31 of the device 12 to the video monitor 112.

The supply cable 56 may extend through the first opening 41 in the first end 32 of the base 12 to the fixed end 40. The cable 20 may extend through a channel 62 in the fixed end 40. The cable 20 may extend inward with respect to the movable end 42 from the first end 32 of the base 16. The cable 20 may engage the pulley 52 and/or may extend inwards with respect to the first end 32 from the pulley 52. The cable 20 may engage the roller 54 and/or may extend through the second opening 43 in the base 16. The roller 54 may direct the cable in a direction which may be non-parallel to the length 46 between the first end 32 and the second end 34 of the base 16. The cable 20 may extend outward with respect to the interior 38 of the base 16 through the second opening 43 of the base 16 beyond the exterior 36 of the base 16. The end 58 of the cable 20 may be located outside of the base 16 and/or the interior 38 of the base 16. The length 60 of the cable 20 may allow the cable 20 to engage the pulley 52 and the roller 54 and/or may permit the end 58 of the cable 20 to extend outside of the base 16.

The user may apply an outward force with respect to the exterior 36 of the base to the end 58 of the cable 20. As a result, the cable 20 may pull the pulley 52 and/or the movable end 42 inward with respect to the fixed end 40 of the base 16. The pulley 52 and/or the movable end 42 may be pulled by the cable 20 to a position adjacent to the roller 54 and/or the second opening 43. As a result, the end 58 of the cable 20 may be separated from the base 16 by a distance which may correspond to the length 46 of the base 16.

The user may move the end 58 of the cable 20 to a position adjacent to the second opening 43 of the base. The movable end 42 may move outward with respect to the fixed end 40 of the base. The movable end 42 and/or the pulley 52 may move to a position adjacent to the second end 43 of the base 16. As a result, the movable end 42 and/or the pulley 52 may retract the cable 20 inward with respect to the exterior 36 of the base 16. Moreover, the movable end 42 and/or the pulley 52 may retract the end 58 of the cable 20 inward with respect to the exterior 36 of the base 16 to a position which may adjacent to the base 16.

The end 58 of the cable 20 may be attached to a connector 64. The connector 64 may have an interior 66, an exterior 68, a front side 70, a first end 72 and/or a second end 74. The second end 74 may be opposite in location to the first end 72. The first end 72 may have passages 76, 77 that may extend through the first end 72 from the exterior 68 to the interior 66 of the connector 64. The front side 70 may have a first window 78*a* and a second window 78*b*. The first window 78*a* and the second window 78*b* may extend through the front side 70 from the exterior 68 to the interior 66 of the connector 64. Further, the interior 66 of the connector 64 may have a plurality of heads 80. The end 58 of the cable 20 and/or the plurality of electrical wires 60 of the cable 20 may be connected to the plurality of heads 80. Moreover, each of the plurality of heads 80 may correspond to each of the electrical pathways provided by the plurality of electrical wires 60 of the cable 20.

The sensor board 14 may have a front side 81, a top side 82, a bottom side 84, a first wall 86 and/or a second wall 88. The bottom side 84 may be opposite in location to the top side 82. The second wall 88 may be opposite in location to the first wall 86. Further, the sensor board 14 may have an orifice 90 and/or a fastener 92. The orifice 90 may extend through the sensor board 14 from the bottom side 84 to the top side 82. The fastener 92 may be inserted into the orifice 90 and/or may be inserted into the mounting hole 28 on the underside 26 of the device 12. The fastener 92 may be, for example, a screw. As a result, the fastener 92 may lock into the mounting hole and/or may attach the sensor board 14 to the device 12. The first wall 86 and/or the second wall 88 may be located between the underside 26 of the device 12 and the top side 82 of the sensor board 14. Moreover, the first wall 86 may have passages 87, 89 that may extend through the first wall 86.

The sensor board 14 may have an optical sensor 96 connected to the second micro-controller 94. The bottom side 84 of the sensor board 14 may have a plurality of heads 99 connected to the micro-controller 94. The plurality of heads 99 of the sensor board 14 may correspond with and/or may be connected to the plurality of heads 80 of the connector 64.

The sensor board 14 may have a voltage plug 98 and/or a video in-line 97 extending outward with respect to the first wall 86. The voltage plug 98 may be inserted into the DC plug-in 30 of the device 12 and/or may be connected to the second micro-controller 94 and/or the programmable power supplier 108. The second micro-controller 94 may determine the required operational voltage of the device 12 via the voltage plug 98 and the DC plug-in 30. The second micro-controller 94 may communicate with the device 12 via the voltage plug 98 and the DC plug-in 30 to determine the required operational voltage of the device 12. The micro-controller 94 may communicate the required operational voltage of the device 12 to the first micro-controller 23 via the plurality of electrical wires 60. Moreover, the second micro-controller 94 may be programmed to determine the required operational voltage of the device 12, to communicate with the device 12 and/or to communicate the required operational voltage of the device 12 to the microprocessor 23.

The first micro-controller 23 may control the programmable power supplier 108 and/or may adjust the output voltage of the programmable power supplier 108 to the required operational voltage of the device 12. The first micro-controller 23 may deliver the required operational voltage of the device 12 to the second micro-control 94 via the plurality of electrical wires 60. The second micro-control 94 may deliver the required operational voltage of the device 12 to the device 12 via the voltage plug 98 and DC plug-in 30.

In an alternative embodiment, the first micro-controller 94 may be programmed with the required operational voltage of the device 12. The first micro-controller 94 may control the programmable power supplier 108. Further, the programmable power supplier 108 may provide the required operational voltage to the device 12 via the cable 20, the voltage plug 98 and/or the DC plug-in 30.

The front side 81 of the sensor board 14 may have a first light emitting diode 100 (hereinafter "first LED 100") and/or a second light emitting diode 102 (hereinafter "second LED 102"). The second micro-controller 94 may be connected to the second LED 102. The programmable power supplier 108 may be connected to and/or may control the first LED 100. Still further, the second micro-controller 94 may control the second LED 102. The first LED 100 may emit a color, such as, for example, green. The programmable power supplier 108 and/or the first micro-controller 23 may activate the first LED 100 to indicate that the voltage is being supplied to the device 12. The second LED 102 may emit a color, such as, for example, red. However, the present invention should not be deemed as limited to the color of the plurality of the first LED 100 and/or the second LED 102. The second micro-controller 94 may be programmed to control the second LED 102.

The interior 66 of the connector 64 may receive the sensor board 14, the first wall 86 and/or the second wall 88. As a result, the connector 64 may be adjacent to and/or may abut the device 12. The sensor board 14, the first wall 86 and/or the second wall 88 may be enclosed between the underside 26 of the device 12 and the exterior 68 of the connector 64. Further, the first window 78*a* and the second window 78*b* of the front side 70 of the connector 64 may align with the first LED 100 and/or the second LED 102, respectively on the front side 81 of the sensor board 14. As a result, the first LED 100 and/or the second LED 102 may emit light which may be visible through the first window 78*a* and the second window 78*b*, respectively, and/or may be visible from the exterior 68 of the connector 64.

Still further, the passages 76, 77 in the first end 72 of the connector 64 may align with the passages 87, 89 in the first wall 86 of the sensor board 14, respectively. A pin 104 may be inserted into the passages 76, 87 of the connector 64 and the sensor board 14, respectively. As a result, the connector 64 and/or the cable 14 may be attached and/or may be locked to the sensor board 14 and/or the device 12. The pin 104 may be, for example, a screw and/or the like. Moreover, the sensor board 14 and/or the device 12 may be attached to and/or may be locked to the base 16 and/or the fixture 48. The sensor board 14 may be connected to the alarm box 22, the alarm board 21, the first micro-controller 23 and/or the programmable power supplier 108. It should be understood that the pin 104 may be replaced with or used in conjunction with any fastener that are generally known and may be implemented by one having ordinary skill in the art.

The connector 64 may be attached to the sensor board 14 and/or the device 12 via the pin 104 and the passages 76, 87 of the connector 64 and the sensor board 14, respectively. As a result, the second micro-controller 94 of the sensor board 14 may be in communication with the first micro-controller 23 of the power supply board 18. Each of the plurality of heads 99 of the sensor board 14 may align with and/or may be connected to each of the plurality of heads 80 of the connector 64. Further, the plurality of heads 80, 99 may allow the second micro-controller 94 to communicate with the first micro-controller 23 via the cable 20 and/or the plurality of electrical wires 60. Still further, the second micro-controller 94 may communicate the required operational voltage of the device 12 to the first micro-controller 23 from the programmable power supplier 108 via the cable 20 and/or the plurality of electrical wires 60. As a result the first micro-controller 23 may adjust the output voltage of the programmable power supplier 108 to the required operational voltage of the device 12. Moreover, the programmable power supplier 108 may provide and/or may deliver the required operational voltage to the device and/or the output voltage to the second micro-controller 94 via the cable 20, the plurality of electrical wires 60, the voltage plug 98 and/or the DC plug-in 30.

The device 12 may, therefore, be activated with the required operational voltage provided from the programmable power supplier 108. The first LED 100 may be activated by the programmable power supplier 108 to indicate that the device 12 has been activated. The programmable power supplier 108 may activate the first LED 100 to indicate that the second micro-controller 94 may be receiving the output voltage from the power source 24 via the cable 20.

The optical sensor 96 may detect and/or may monitor the pin 104 extending through the passages 76, 87 of the connector 64 and the sensor board 14, respectively. The optical sensor 96 may indicate to the second micro-controller 94 of the sensor board 14 that the pin 104 is located within the passages 76, 87 of the connector 64 and the sensor board 14, respectively. Further, the second micro-controller 94 of the sensor board 14 may communicate the presence of the pin 104 to the first micro-controller 23 via the cable 20 and/or the plurality of electrical wires 60. As a result, the first micro-controller 23 may activate the alarm box 22 and/or the alarm board 21. The second micro-controller 94 and/or the first micro-controller 23 may activate the second LED 102 to indicate that the alarm box 22 has been activated. The second micro-controller 94 may be programmed to communicate with the optical sensor 96 and/or the first micro-controller 23. The optical sensor 96 may be programmed to detect the pin 104.

The second micro-controller 94 may be programmed to detect a signal from an external sensor 114. The external sensor 114 may transmit, for example, a radio signal to the second micro-controller 94. The second micro-controller 94 may communicate to the first micro-controller 23, the alarm box 22 and/or the alarm board 21 if the second micro-controller 94 has received the signal from the external sensor 114. The signal from the external sensor 114 may indicate that the second micro-controller 94 is within a radius, such as, for example, ten feet, twenty feet or thirty feet from the external sensor 114.

The optical sensor 96 may communicate to the second micro-controller 94 if the pin 104 is removed from the passages 76, 87 of the connector 64 and the sensor board 14, respectively. The second micro-controller 94 may signal the first micro-controller 23 if the pin 104 is removed from the passages 76, 87 of the connector 64 and the sensor board 14, respectively, via the cable 20 and/or the plurality of electrical wires 60. The first micro-controller 23 may trigger the alarm box 22 and/or the alarm board 21 if the pin 104 is removed from the passages 76, 87. As a result, the optical sensor 96 may be coupled to the alarm box 22 and/or the alarm board 21 via the cable 20, the plurality of electrical wires 60, the second micro-controller 94 and/or the first micro-controller 23. The optical sensor 96, the first micro-controller 23 and/or the second micro-controller 94 may electrically secure the device 12.

The device 12 may transmit a video signal to the second micro-controller 94 of the sensor board 14 via the video out-line 31 of the device 12 and/or the video in-line 97 of the sensor board 14. The video in-line 97 and/or the voltage plug 98 may pass through passages 77, 89 of the connector 69 and the first wall 86 of the sensor board 14, respectively. The second micro-controller 94 and/or the first micro-controller 23 may store the video signal. The video signal may be, for example, a streaming video signal, a still video image and/or the like. The second micro-controller 94 of the sensor board 14 may communicate the video signal to the first micro-controller 23 via the cable 20 and/or the plurality of electrical wires 60. Further, the video signal may also have, for example, an audio signal. The second micro-controller 94 and/or the first micro-controller 23 may be programmed to store the video signal of the device 12 and/or to communicate the video signal.

The first micro-controller 23 may transmit the video signal from the device 12 to the video monitor 112, such as, for example, a television, a computer monitor and/or the like. In an alternative embodiment, the device 12 may transmit the video signal to the video monitor 112 via the video out-line 31, the plurality of electrical wires 60 and/or the cable 20. Still further, the video monitor 112 may be located adjacent to the device 12 and/or may be controlled by the first micro-controller 23. Moreover, the video monitor 112 may have, for example, audio speakers (not shown) to produce the audio signal transmitted from the device 12. The first micro-controller 23 may be programmed to transmit the video signal and/or the audio signal to the video monitor 112.

The sensor board 14 may be attached to the underside 26 of the device 12 via the fastener 92. Further, the video in-line 97 and the voltage plug 98 of the sensor board 14 may be inserted into the video out-line 31 and the direct current plug-in 30, respectively, of the device 12. The sensor board 14 may be inserted into the interior 66 of the connector 64. As a result, each of the plurality of heads 99 of the sensor board 14 may connect to each of the plurality of heads 80 of the connector 64, respectively. The second micro-controller 94 of the sensor board 14 may communicate the required operational voltage of the device 12 to the first micro-controller 23 board 18 via the cable 20. The first micro-controller 23 may adjust the output voltage of the programmable power supplier 108 to the required operational voltage of the device 12 and/or may deliver the required operational voltage to the second micro-controller 94 and/or the device via the cable 20. The second micro-controller 94 and/or the programmable power supplier 108 may deliver the required operational voltage to the device 12 via the video in-line 97 and the DC plug-in 30.

The pin 104 may be inserted into passages 76, 87 of the connector 64 and the sensor board 14, respectively, to secure the sensor board 14 to the connector 64. The optical sensor 96 of the sensor board 14 may detect the pin 104 extending through the passage 87 of the sensor board 14. The optical sensor 96 may signal the second micro-controller 94 that the pin 104 is extending through the passage 87 of the sensor board 14. The second micro-controller 94 may communicate to the first micro-controller 23 that the pin 104 is extending through the passage 87. The first micro-controller 23 may activate the alarm box 22 and/or the alarm board 21. The first micro-controller 23 may communicate to the second micro-controller 94 that the alarm box 22 and/or the alarm board 21 has been activated. The second micro-controller 94 may activate the second LED 102 to indicate that the alarm box 22 and/or the alarm board 21 has been activated.

The optical sensor 96 may communicate to the second micro-controller 94 if the pin 104 has been removed from the passage 87 of the connector 64. The second micro-controller 94 may communicate to the first micro-controller 23 that the pin 104 has been removed from the passage 87. The second micro-controller 94 may deactivate the second LED 102 to indicate that the pin 104 has been removed from the sensor board 14. The first micro-controller 23 may trigger the alarm board 21 in the alarm box 22. The alarm board 21 may produce an audio signal which may indicate that the pin 104 has been removed from the sensor board 14 and/or that the device 12 is unsecured. The pin 104 may be replace in the passages 76, 87 of the connector 64 and the sensor board 14, respectively. As a result, the first micro-controller 23 may disengage the alarm board 21 which may stop the alarm board 21 from producing the audio signal.

The user and/or a customer may examine, may inspect and/or may utilize the device 12. The user may exert an outward force with respect to the base 16 on the device 12 and/or the end 58 of the cable 20. The movable end 42 and/or the pulley 52 of the base may move inward with respect to the fixed end 40 and/or the roller 54 along the interior 38 of the base 16. The outward force of the user may move the pulley 52 to a position which may be adjacent to the roller 54 of the base 16. As a result, the device 12 and/or the end 58 of the cable 20 may be separated from the base 16 may be a distance corresponding to the length 46 of the base 16. The pulley 52 and/or the roller 54 may reduce friction along the cable 20 and/or may prevent damage to the cable 20 and/or the coating 63 of the cable 20. Further, the end 58 of the cable 20 may extend to, for example, three feet from the second opening 43 of the base 16. As a result, the user may move the device 12 allowing the user to examine and/or inspect the device 12 and/or functions provided by the device 12.

The user may examine and/or may inspect, for example, a weight of the device, a configuration of the device, a texture of an exterior of the device and/or the like. As a result, a user having a disability, such as, for example, being confined to a wheel chair may be permitted to examine and/or to inspect the device 12. Moreover, the device 12 may remain electrically and mechanically secured to the base 16, the alarm board 21, the alarm box 22 and/or the fixture 48 as the user examines and/or inspects the device 12. The user may activate and/or may utilize the device 12 to perform the functions provided by the device 12. For example, the device 12 may be a digital camera and the user may use the device 12 to perform the function of capturing an image (not shown in the drawings). As a result, the device 12 may display the image thereon and/or may transmit the image to the monitor 112. The user may examine and/or inspect the image captured by the device 12.

The user may return the device 12 and/or the end 58 of the cable 20 to a position which may be adjacent to the second opening 43 of the base 16. The movable end 42 may move outward with respect to the fixed end 40 of the base. The movable end 42 and/or the pulley 52 may move to a position adjacent to the second end 43 of the base 16. As a result, the movable end 42 and/or the pulley 52 may retract the device 12 and/or the cable 20 inward with respect to the exterior 36 of the base 16. Moreover, the movable end 42 and/or the pulley 52 may retract the device 12 and/or the end 58 of the cable 20 inward with respect to the exterior 36 of the base 16 to a position which may be adjacent to the exterior of the base 16.

The system 10 may secure the device 12 to the base 16 and/or the fixture 48 via the cable 20. Further, the system 10 may connect the device 12 to the alarm board 21, the alarm box 22 and/or the programmable power supplier 108 via the sensor board 14, the connector 64, the cable 20, the supply cable 56, the alarm connector 19 and/or the plurality of electrical wires 60. The second micro-controller 94 of the sensor board 14 may be in communication with the first micro-controller 23 via the connector 64, the cable 20 and/or the plurality of electrical wires 60. Still further, the device 12 may be monitored by the alarm box 22, the alarm board 21, the optical sensor 96, the second micro-controller 94, the external sensor 114, the pin 104, the cable 20 and/or the plurality of electrical wires 60. The second micro-controller 94 and/or the first micro-controller 23 may control the voltage delivered from the programmable power supplier 108 to the device 12. Moreover, the first LED 100 and/or the second LED 102 of the sensor board 14 may indicate that power is provided to the device 12 and/or that the alarm box 22 has been activated, respectively. The cable 20 and/or the base 16 may allow the device 12 to be manipulated, to be examined and/or to be utilized by a customer and/or a user. Furthermore, it should be understood that the first micro-controller 23 and/or the power supply board 18 may be in communication with more than one device 12, the first micro-controller 23, the second micro-controller 94, the sensor board 14, the base 16, the programmable power supplier 108 and/or the cable 20.

As illustrated by FIGS. 3 and 4, the alarm box 22, the alarm board 21 and/or the power source 24 may be connected to the plurality of second micro-controllers 94*a*, 94*b*, 94*c*, 94*d* via the first micro-controller 23. Each of the plurality of devices 12*a*, 12*b*, 12*c*, 12*d* may be in communication with the first micro-controller 23, the alarm box 22 and/or the alarm board 21 via the plurality of second micro-controllers 94*a*, 94*b*, 94*c*, 94*d*, respectively. The programmable power supplier 108 may be controlled by the first micro-controller and/or may provide the required operational voltage to each of the plurality of devices 12*a*, 12*b*, 12*c*, 12*d*. Each of the plurality of second micro-controllers 94*a*, 94*b*, 94*c*, 94*d* may have and/or may be in communication with the optical sensor 96. Each of the plurality of devices 12*a*, 12*b*, 12*c*, 12*d* may be in communication with and/or transmitting the video-signal to the monitor 112.

The optical sensor 96 of each of the plurality of second micro-controllers 94*a*, 94*b*, 94*c*, 94*d* may detect the pin 104. The optical sensor 96 may signal each of the plurality of second micro-controllers 94*a*, 94*b*, 94*c*, 94*d* that the pin 104 has been detected. The each of the plurality of second micro-controllers 94*a*, 94*b*, 94*c*, 94*d* may communicate to the first micro-controller 23 that the pin 104 has been detected. The first micro-controller 23 may activate the alarm box 22 and/or the alarm board 21. The first micro-controller 23 may communicate to the second micro-controller 94 that the alarm box 22 and/or the alarm board 21 has been activated. Each of the second micro-controller 94 may have the second LED 102. Each of the second micro-controllers 94*a*, 94*b*, 94*c*, 94*d* may activate the second LED 102 to indicate that the alarm box 22 and/or the alarm board 21 has been activated.

The optical sensor 96 may communicate to each of the plurality of second micro-controllers 94*a*, 94*b*, 94*c*, 94*d* if the pin 104 has been removed. Each of the plurality of second micro-controllers 94*a*, 94*b*, 94*c*, 94*d* may communicate to the first micro-controller 23 that the pin 104 has been removed. Each of the second micro-controller 94 may deactivate the second LED 102 to indicate that the pin 104 has been removed. The first micro-controller 23 may trigger the alarm board 21 in the alarm box 22. The alarm board 21 may produce an audio signal which may indicate that the pin 104 has been removed and/or that one of the plurality of devices 12*a*, 12*b*, 12*c*, 12*d* is unsecured. As a result, the first micro-controller 23 may disengage if the optical sensor 96 of each of the plurality of second micro-controllers 94*a*, 94*b*, 94*c*, 94*d* detects the pin 104. As a result, the first micro-controller 23 may signal the alarm board 21 to stop the alarm board 21 from producing the audio signal.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A method for monitoring a secured condition of a device wherein the device requires a voltage, the method comprising the steps of:

providing a first controller having an alarm and a power source wherein the power source provides the voltage to the device;

providing a second controller that communicates with the device wherein the second controller provides the voltage to the device from the power source and further wherein the first controller is remotely positioned from the second controller; and activating the alarm wherein the second controller senses a breach of the secured condition and signals the first controller.

2. The method of claim 1 further comprising the step of:

providing an external sensor to communicate with the second controller.

3. The method of claim 1 further comprising the step of:

providing a monitor in communication with the device.

4. The method of claim 1 further comprising the step of:

programming the second controller with a voltage necessary to power the device.

5. The method of claim 1 further comprising the step of:

communicating the voltage required to operate the device from the device to the first controller via the second controller.

6. The method of claim 1 further comprising the step of:

indicating that the second controller is in communication with the first controller.

7. The method of claim 1 further comprising the step of:

transmitting a signal from the device to the first controller.

* * * * *